US008376360B2

(12) United States Patent
Moriyama et al.

(10) Patent No.: US 8,376,360 B2
(45) Date of Patent: Feb. 19, 2013

(54) SHEET STACKING APPARATUS AND SHEET STACKING CONTROL METHOD

(75) Inventors: Tsuyoshi Moriyama, Toride (JP); Hitoshi Kato, Toride (JP); Yasuo Fukatsu, Abiko (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/116,122

(22) Filed: May 6, 2008

(65) Prior Publication Data

US 2008/0277867 A1 Nov. 13, 2008

(30) Foreign Application Priority Data

May 8, 2007 (JP) ..... 2007-123375

(51) Int. Cl.
*B65H 39/10* (2006.01)

(52) U.S. Cl. ..... 271/298; 271/288; 271/289; 271/279

(58) Field of Classification Search ..... 271/288, 271/289, 290, 279, 298, 299, 213–217
See application file for complete search history.

(56) References Cited

U.S. PATENT DOCUMENTS

| | | | | |
|---|---|---|---|---|
| 5,096,181 | A * | 3/1992 | Menon et al. | 271/157 |
| 5,415,514 | A * | 5/1995 | Butterfield | 414/403 |
| 5,551,686 | A * | 9/1996 | Sanchez et al. | 271/298 |
| 5,823,529 | A * | 10/1998 | Mandel et al. | 271/296 |
| 5,961,115 | A * | 10/1999 | Blanck et al. | 271/263 |
| 6,408,147 | B1 * | 6/2002 | Oshida | 399/82 |
| 6,669,386 | B1 * | 12/2003 | Myers et al. | 400/625 |
| 7,245,871 | B2 * | 7/2007 | Kasahara | 399/405 |
| 7,280,781 | B2 * | 10/2007 | Willis | 399/81 |
| 7,374,163 | B2 * | 5/2008 | Cook et al. | 271/145 |
| 7,441,773 | B2 * | 10/2008 | Kasahara et al. | 271/287 |
| 7,597,324 | B2 * | 10/2009 | Obuchi et al. | 271/288 |
| 7,734,210 | B2 * | 6/2010 | Nishida | 399/81 |

FOREIGN PATENT DOCUMENTS

| | | |
|---|---|---|
| JP | 02-070667 A | 3/1990 |
| JP | 2006-124052 A | 5/2006 |
| JP | 2006-256826 A | 9/2006 |

* cited by examiner

*Primary Examiner* — Luis A Gonzalez
(74) *Attorney, Agent, or Firm* — Canon USA Inc. IP Division

(57) ABSTRACT

A sheet stacking apparatus including first and second stacking trays configured to stack sheets, a detection unit configured to detect a sheet stacking amount on the first stacking tray, a setting unit configured to set an upper limit on stacking amount for controlling the sheet stacking amount that is less than a maximum sheet stacking amount on the first stacking tray, and a control unit configured to stop stacking of sheets on the first stacking tray and stack sheets on the second stacking tray in a case where the sheet stacking amount which is detected by the detection unit reaches the upper limit on stacking amount that is set by the setting unit.

4 Claims, 22 Drawing Sheets

SHEET STACKING APPARATUS AND SHEET STACKING CONTROL METHOD

BACKGROUND OF THE INVENTION

1. Field of the Invention

The present invention relates to sheet stacking, more specifically control for stacking sheets that are discharged from an image forming apparatus on a plurality of sheet stacking units.

2. Description of the Related Art

In recent years, an image forming apparatus that forms an image on a sheet could discharge a large number of sheets at high speed. Consequently, there is a demand that a sheet stacking apparatus receive and stack sheets discharged from the image forming apparatus main body that is capable of stacking a large number of sheets while maintaining the stacking alignment of the sheets. Japanese Patent Application Laid-Open No. 2006-124052 discusses a sheet stacking apparatus (hereinafter referred to as a "stacker apparatus") which responds to such a requirement.

FIG. 24 illustrates a cross-sectional view of a conventional stacker apparatus.

In a stacker apparatus 500, an inlet roller 501 receives a sheet which is discharged from an image forming apparatus main body. A conveyance roller pair 502 then delivers the sheet to a gripper 503. The gripper 503 grips and conveys the sheet so that a leading edge of the sheet abuts on a leading edge stopper 504. When the sheet abuts on the leading edge stopper 504, the gripper 503 releases the sheet to fall onto a sheet stacking tray 505. At this time, the sheet falls between the leading edge stopper 504 and a trailing edge stopper 508, so that the leading edge and the trailing edge of the sheet are aligned. Further, a side edge of the sheet which is perpendicular to a sheet conveyance direction is aligned by a width alignment mechanism (not illustrated) as necessary.

In the above-described conventional stacker apparatus, if a number of sheets that are stacked on the sheet stacking tray 505 reaches the maximum stacking capacity, or a print job ends before reaching the maximum stacking capacity, the sheets that are stacked on the sheet stacking tray 505 become ready for taking out.

However, in the above-described conventional stacker apparatus, when a number of sheets to be printed in a job is greater than or equal to the maximum stacking capacity, the sheets cannot be taken out until the sheet stacking tray 505 is fully stacked thereon. Further, when the fully-stacked sheet stacking tray 505 is transported to a separate bookbinding apparatus for bookbinding processing, if a number of prints which the bookbinding apparatus can process for one time is less than the maximum stacking capacity of the stacker apparatus, the start of the bookbinding process is delayed by the difference in the number of sheets handled by the two apparatuses. As a result, the bookbinding apparatus cannot be operated efficiently.

Further, if the sheets are strongly curled, the stacked sheets become more prone to collapse as the sheet stacking amount increases.

In order to prevent the sheets from collapsing, a job which prints a large number of sheets can be divided into a plurality of jobs that print fewer sheets. However, it is burdensome for a user to prepare a divided job, and productivity is degraded.

SUMMARY OF THE INVENTION

The present invention is directed to a sheet stacking apparatus and a method of controlling sheet stacking that allows a user to take out a sheet stack which is stacked on a sheet stacking unit at a desired time.

According to an aspect of the present invention, a sheet stacking apparatus which stacks sheets that are discharged from an image forming apparatus includes first and second stacking tray configured to stack sheets, a detection unit configured to detect sheet stacking amount on the first stacking tray, a setting unit configured to set an upper limit on stacking amount for controlling the sheet stacking amount that is less than a maximum sheet stacking amount on the first stacking tray, and a control unit configured to stop stacking of sheets on the first stacking tray and stack sheets on the second stacking tray in a case where the sheet stacking amount detected by the detection unit reaches the upper limit on stacking amount set by the setting unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
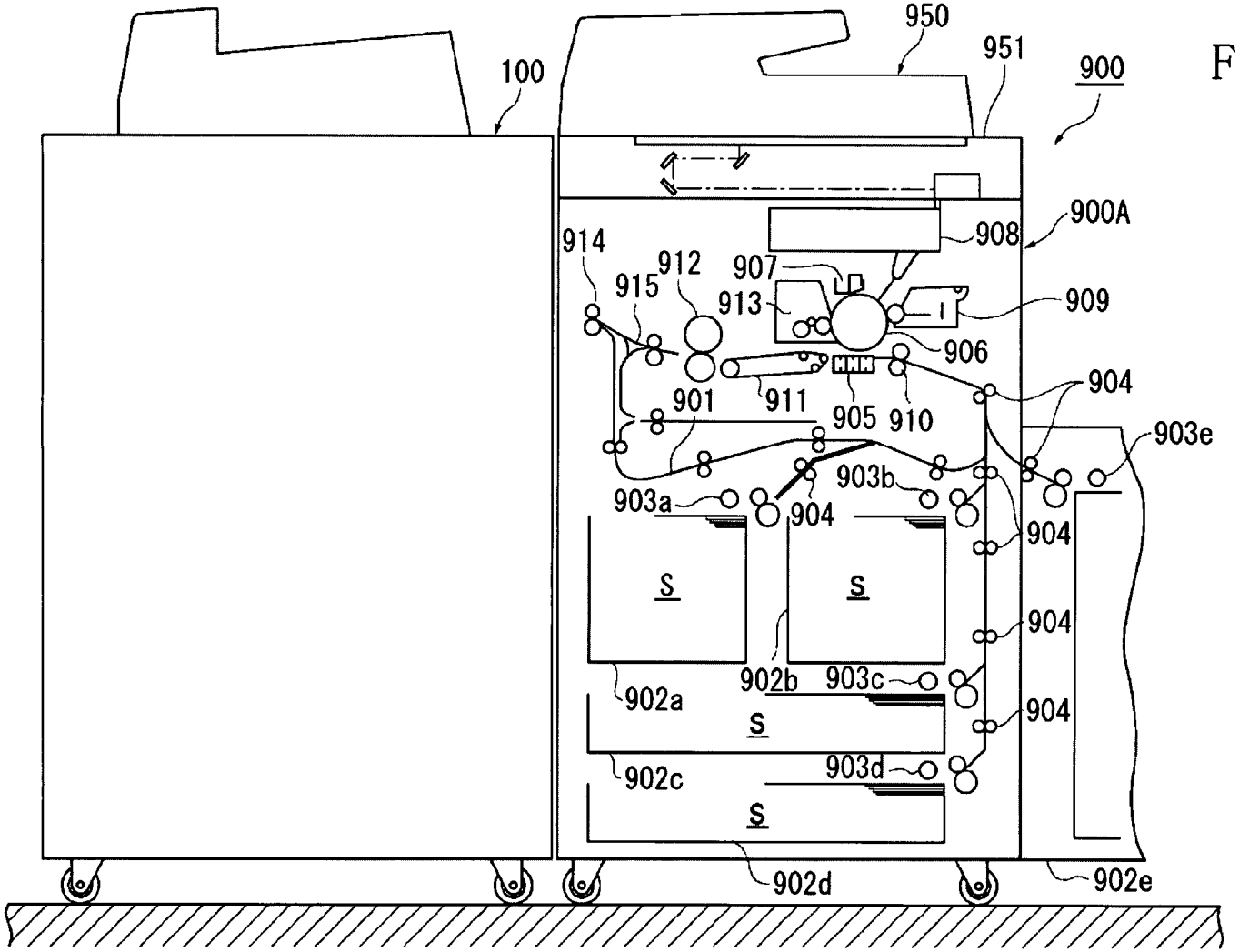
FIG. 1 is a cross-sectional view illustrating a configuration of an example image forming apparatus according to an exemplary embodiment of the present invention.

FIG. 1 illustrates a cross-sectional view of an image forming apparatus according to an exemplary embodiment of the present invention. The cross-sectional view is illustrated along a sheet conveying direction of the image forming apparatus.

In an image forming apparatus 900, an apparatus main body (i.e., image forming unit) 900A includes a sheet stacking apparatus (hereinafter referred to as "stacker apparatus") 100. The stacker apparatus 100 is connected to the apparatus main body 900A as an optional apparatus. However, the stacker apparatus 100 can be integrated into the apparatus main body 900A.

The apparatus main body 900A includes an image reader 951 and an automatic document feeder 950 on the upper portion. A sheet "S" which is set in sheet cassettes 902*a*, 902*b*, 902*c*, 902*d*, and 902*e* is conveyed to a registration roller pair 910 by feeding rollers 903*a*, 903*b*, 903*c*, 903*d*, and 903*e* and a conveyance roller pair 904.

A photosensitive drum 906 which is charged by a primary charging device 907 is exposed to light by an exposure unit 908, and digital data of a document read by the image reader 951 is formed into an electrostatic latent image on the photosensitive drum 906. A development device 909 then develops the electrostatic latent image formed on the photosensitive drum 906 into a toner image.

The registration roller pair 910 conveys the sheet which enters between the photosensitive drum 906 and a transfer unit 905 in alignment with a position of the toner image. The transfer unit 905 transfers the toner image from the photosensitive drum 906 onto the sheet. Superfluous matter such as residual toner which is not transferred to the sheet and remaining on the photosensitive drum 906 is cleaned off by a blade of a cleaning device 913. As a result, the surface of the photosensitive drum 906 is cleaned in preparation for the next image forming.

A conveyance belt 911 conveys the sheet on which the toner image is formed to the fixing device 912. The sheet is then pinched between a heating roller and a pressure roller of the fixing device 912 to be heat-pressed, and the toner image is fixed on the sheet. The sheet on which the toner image is fixed is directly conveyed to the stacker apparatus 100 by a discharge roller pair 914. Otherwise, the sheet is conveyed to a two-sided-reversing device 901 by a flapper 915, so that the toner image is again formed on the reverse side of the sheet.

Figure 2:
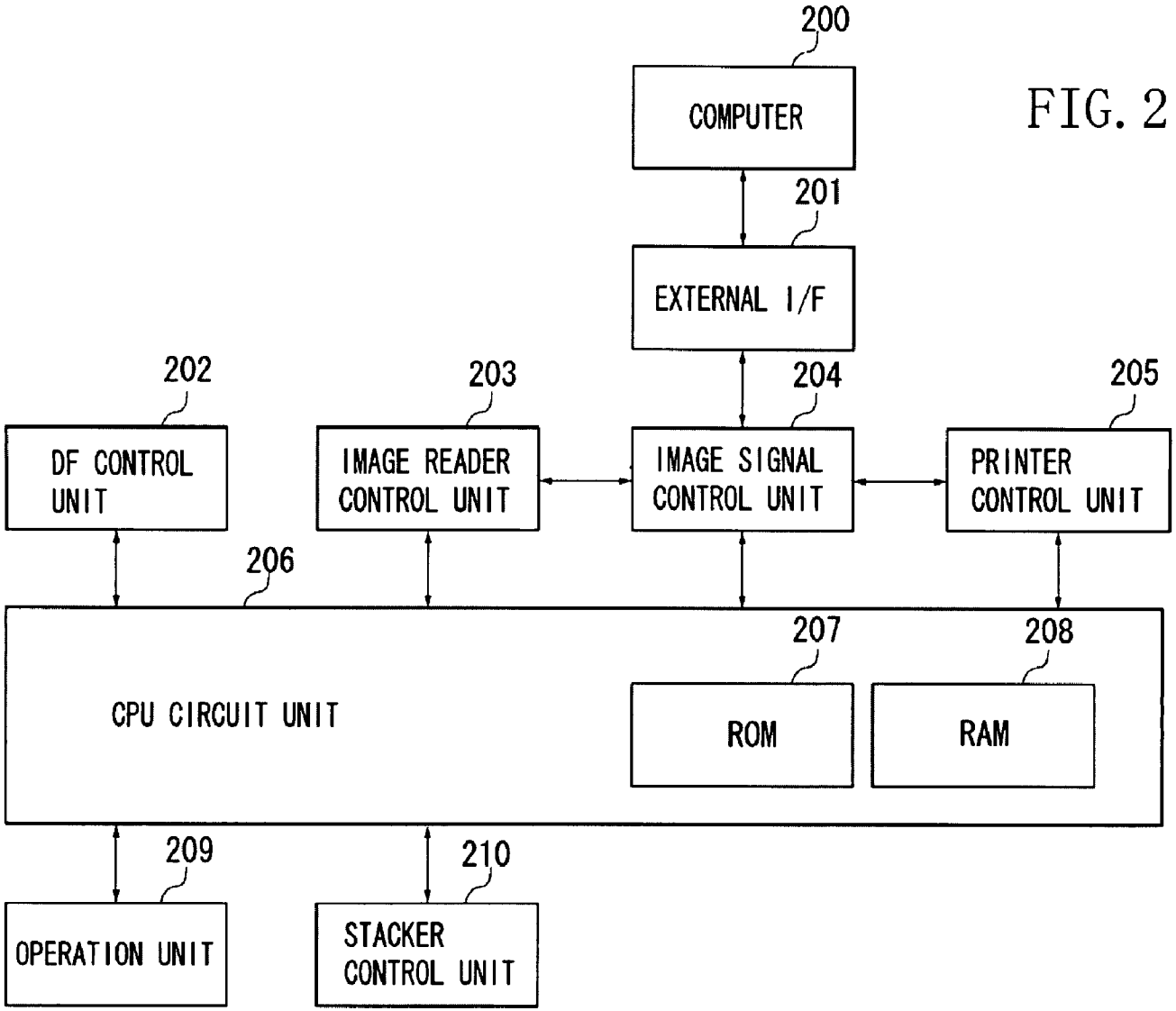
FIG. 2 is a block diagram illustrating an example configuration of a control apparatus which controls a process performed by an image forming apparatus.

FIG. 2 is a block diagram illustrating a control apparatus which controls an operation of the image forming apparatus 900.

Referring to FIG. 2, a central processing unit (CPU) circuit 206 includes a CPU (not illustrated), a read-only memory (ROM) 207, and a random access memory (RAM) 208. The CPU circuit unit 206 performs overall control of the blocks 201, 202, 203, 204, 205, 209, and 210 illustrated in FIG. 2 by executing a control program stored in the ROM 207. The RAM 208 temporarily stores control data and is used as a work area for conducting calculations associated with control performed by the CPU circuit unit 206.

A document feeding (DF) control unit 202 controls driving of the automatic document feeder 950 according to an instruction from the CPU circuit unit 206. An image reader control unit 203 controls driving of a scanner unit and an image sensor inside the above-described image reader 951, and transfers an analog image signal output from the image sensor to an image signal control unit 204.

The image signal control unit 204 converts the analog image signal received from the image sensor into a digital signal and performs various processes on the digital signal. The image signal control unit 204 then converts the digital signal to a video signal for printing, and outputs the video signal to a printer control unit 205. Further, the image signal control unit 204 performs various processes on a digital signal input from a computer 200 via an external interface (I/F) 201, converts the digital signal into a video signal for printing, and outputs the video signal to a printer control unit 205. The CPU circuit unit 206 controls the processes performed by the image signal control unit 204.

The printer control unit 205 controls driving of the above-described exposure unit 908 according to the input video signal.

An operation unit 209 includes a plurality of keys for a user to set various functions associated with image forming, and a display unit for displaying information about the settings. The operation unit 209 outputs to the CPU circuit unit 206 key signals corresponding to operations on each of the keys, and displays an operation screen on the display unit of the operation unit 209 based on a signal from the CPU circuit unit 206. The operation unit 209 will be described in detail below.

A stacker control unit 210 is installed in the stacker apparatus 100. The stacker control unit 210 performs overall control of the stacker apparatus 100 by sending and receiving information to and from the CPU circuit unit 206.

The stacker control unit 210 will be described below with reference to FIG. 3.

Figure 3:
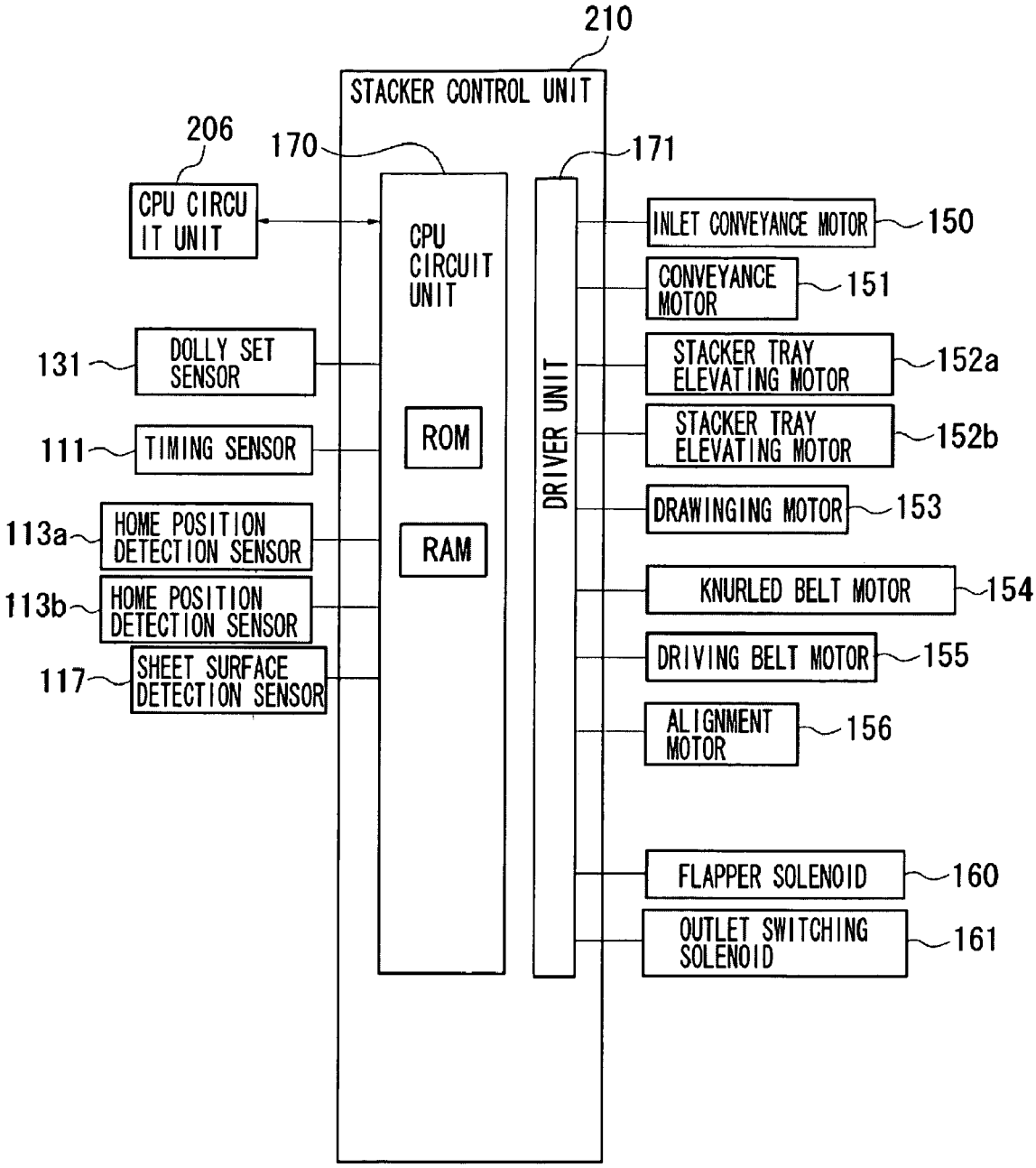
FIG. 3 is a block diagram illustrating an example internal configuration of a stacker control unit and various sensors, motors, and solenoids that are connected to the stacker control unit.

FIG. 3 is a block diagram illustrating an internal configuration of a stacker control unit 210 and various sensors, motors, and solenoids that are connected to the stacker control unit 210.

The stacker control unit 210 includes a CPU circuit 170 and a driver unit 171. The driver unit 171 is connected to various motors 150, 151, 152*a*, 152*b*, 153, 154, 155, and 156 and various solenoids 160 and 161. Further, various sensors 131, 111, 113*a*, 113*b*, and 117 are connected to the CPU circuit 170. Control performed by the CPU circuit unit 170 will be described below.

Figure 4:
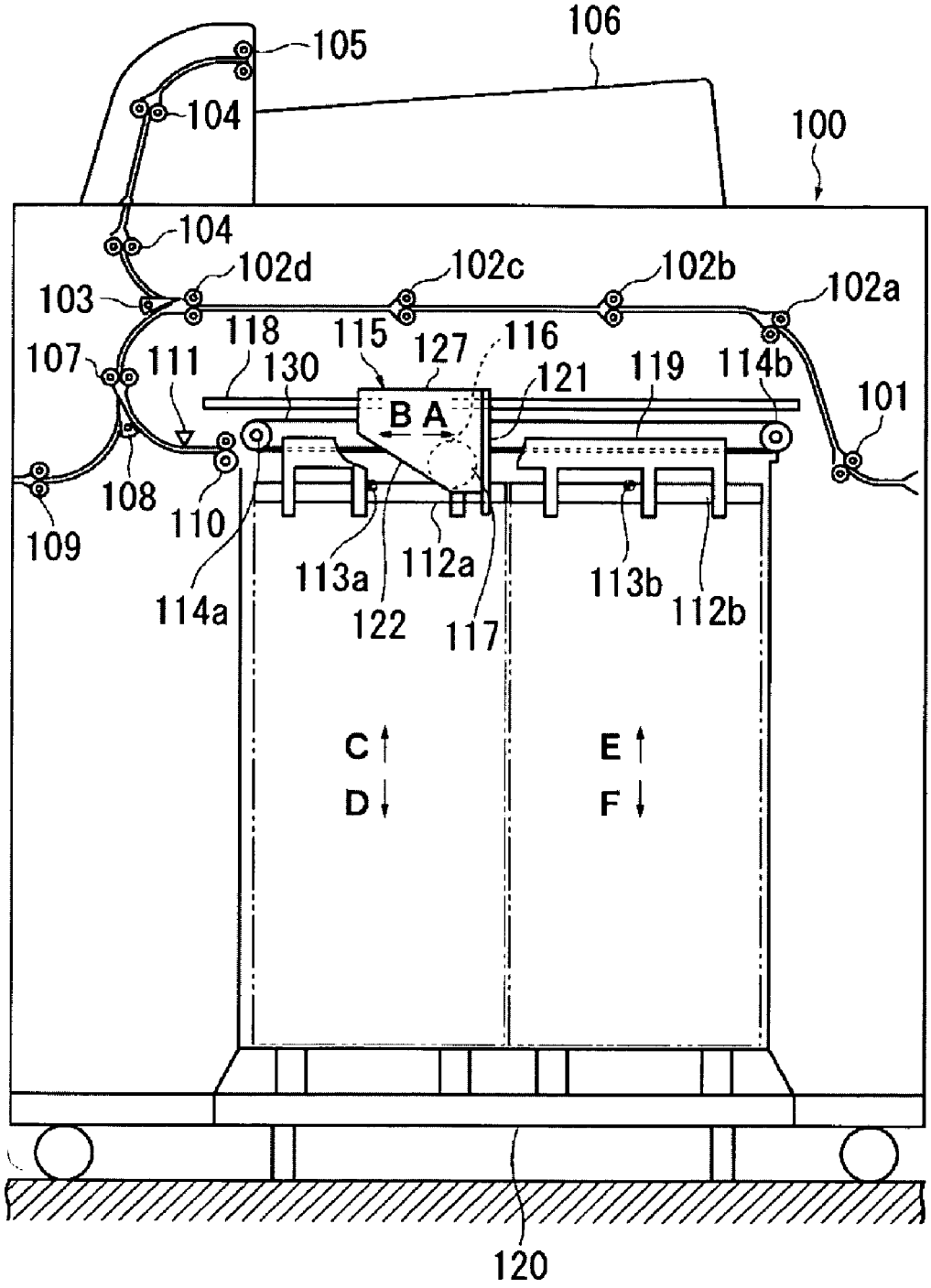
FIG. 4 illustrates a cross-sectional view of an example configuration of a stacker apparatus.
Figure 5:
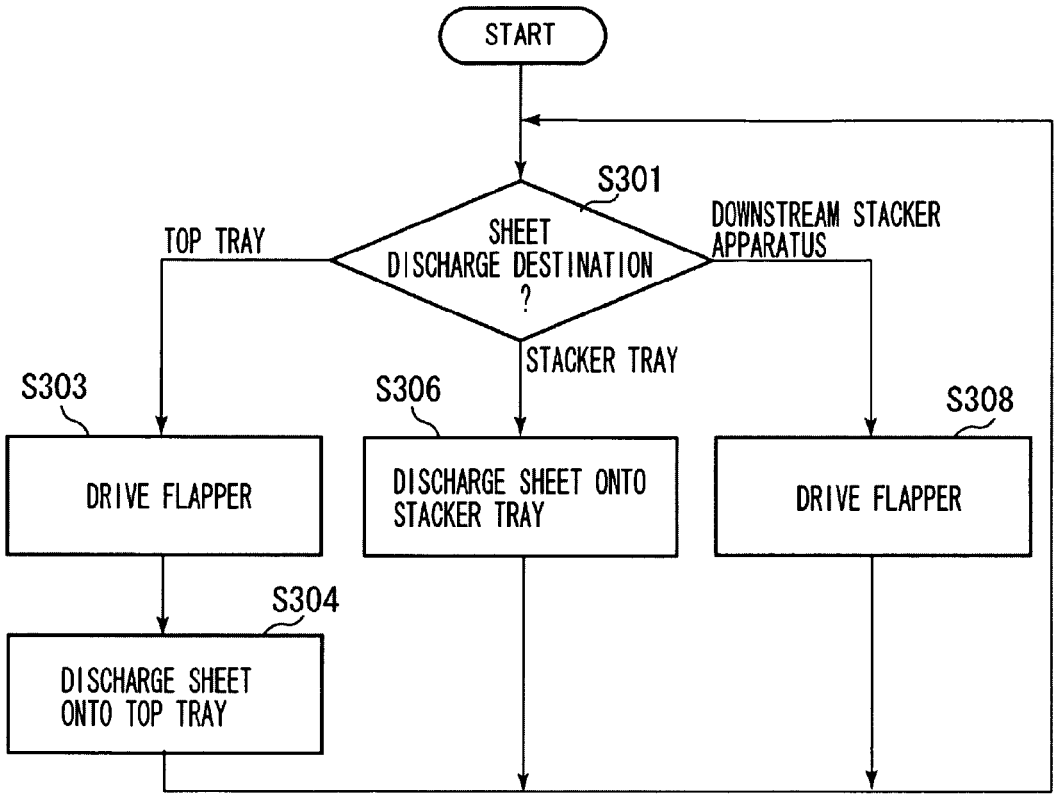
FIG. 5 is a flowchart of a basic operation of a stacker apparatus.

FIG. 4 illustrates a cross-sectional view of the stacker apparatus 100, and FIG. 5 is a flowchart illustrating a basic operation of the stacker apparatus 100. Operation of the stacker apparatus 100 and control performed by the CPU circuit unit 170 will be described below with references to FIGS. 3 to 5.

Referring to FIG. 4, a sheet which is discharged from the apparatus main body 900A (illustrated in FIG. 1) of the image forming apparatus 900 is conveyed into the stacker apparatus 100 by an inlet roller pair 101 of the stacker apparatus 100. Conveyance roller pairs 102*a*, 102*b*, 102*c*, and 102*d* then convey the sheet to a diverter 103. An inlet conveyance motor 150 (illustrated in FIG. 3) drives the inlet roller pair 101 and the conveyance roller pairs 102*a*, 102*b*, 102*c*, and 102*d*. The CPU circuit unit 206 of the image forming apparatus 900 illustrated in FIG. 2 previously sends sheet information to the stacker control unit 210 before the sheet is conveyed to the stacker apparatus 100. The sheet information includes attributes such as a sheet size, a sheet type, and a discharge destination of the sheet.

In step S301 of the flowchart illustrated in FIG. 5, the CPU circuit unit 170 of the stacker control unit 210 determines the discharge destination of the sheet based on the received sheet information. As a result, if the sheet discharge destination is the top tray 106 (illustrated in FIG. 4), the process proceeds to step S303. If the sheet discharge destination is the stacker trays 112*a* and 112*b* (illustrated in FIG. 4), the process proceeds to step S306. If the sheet discharge destination is a stacker apparatus (not illustrated) set further downstream from the stacker apparatus 100, the process proceeds to step S308.

In step S303, the CPU circuit unit 170 drives the flapper solenoid 160 (illustrated in FIG. 3) to switch the diverter 103 so that a tip of the diverter 103 is positioned downwards and guides the sheet to a conveyance roller pair 104. In step S304, the CPU circuit unit 170 drives a conveyance motor 151 (illustrated in FIG. 3) so that a discharge roller pair 105 discharges the sheet onto the top tray 106 to be stacked.

In step S306, the CPU circuit unit 170 discharges the sheet onto the stacker trays 112*a* and 112*b*, as illustrated in FIG. 4. That is, the sheet conveyed by the conveyance roller pair 102*d* is guided to the diverter 103 whose tip is switched to an upward position by the flapper solenoid 160 (illustrated in FIG. 3), and is conveyed by a conveyance roller pair 107. The sheet is then guided to a discharge roller pair 110 by an outlet diverter 108 whose tip is switched to a leftward position. As a result, the discharge roller pair 110 sends the sheet to grippers 114*a* and 114*b*, and the sheet is selectively discharged and stacked on the stacker trays 112*a* and 112*b*. Such a discharge process will be described in detail below.

In step S308, the CPU circuit unit 170 switches the tip of the outlet diverter 108 to a rightward position. The sheet conveyed by the conveyance roller pair 102*d* is guided to an outlet roller pair 109 by the conveyance roller pair 107 and conveyed to the stacker apparatus which is positioned downstream.

The stacker apparatus 100 includes two stacker trays (first and second stacking units) 112*a* and 112*b* to stack sheets, and selectively discharges the sheets on the stacker trays 112*a* and 112*b*. The stacker trays 112*a* and 112*b* can each stack small-size (smaller than or equal to A4 size) sheets. Further, large-size (B4 or A3 size) sheets can be stacked by using both stacker trays 112*a* and 112*b*.

A selective discharge of sheets on the stacker trays 112*a* and 112*b* will be described below.

The peripheral configuration of the stacker trays 112*a* and 112*b* in the stacker apparatus 100 will be described below with reference to FIG. 4.

The stacker trays 112*a* and 112*b* are positioned such that they can move upward and downward in the directions indicated by arrows C, D, E, and F by stacker tray elevating motors 152*a* and 152*b* (illustrated in FIG. 3).

A drawing unit 115 includes a frame 127 which is movable along a slide shaft 118. A drawing motor 153 (illustrated in FIG. 3) moves the drawing unit 115 in directions indicated by arrows A and B. The frame 127 of the drawing unit 115 includes a stopper 121 on which a leading edge of the sheet abuts, and a taper unit 122 which guides the sheet to the stopper 121. Further, the drawing unit 115 includes a knurled belt 116 which is elastic and guides the sheet to the stopper 121.

The knurled belt 116 is rotated counter-clockwise by a knurled belt motor 154 (illustrated in FIG. 3) and guides the sheet to a gap between the knurled belt 116 and the stacker tray 112*a* (or the stacker tray 112*b*). As a result, the leading edge of the sheet abuts on the stopper 121. A sheet surface detection sensor 117 is built into the drawing unit 115, and is used to keep a constant distance between the drawing unit 115 and the upper surface of the sheet.

The grippers 114*a* and 114*b* that convey the sheet by gripping the leading edge of the sheet are mounted on a driving belt 130 biased by a torsion coil spring (not illustrated) in a direction of gripping the sheet. The sheet discharged from the discharge roller pair 110 is then pushed into the grippers 114*a* and 114*b* to be gripped thereby. The grippers 114*a* and 114*b* may be configured such that elastic bodies such as a sponge are placed above and below a V-shaped opening of a member to hold the sheet which are pushed into a gap between the elastic bodies.

The discharged sheets are stacked on the stacker trays 112*a* and 112*b*. When no sheets are stacked, the stacker trays 112*a* and 112*b* each stand by in a home position for stacking sheets. That is, the position of the stacker trays 112*a* and 112*b* are detected by home position detection sensors 113*a* and 113*b* respectively, and the stacker trays 112*a* and 112*b* are moved to the home positions according to the detection results.

FIGS. 6, 7, 8, and 9 are cross-sectional views illustrating a peripheral configuration of the stacker tray 112*a* in the stacker apparatus 100 illustrated in FIG. 4.

Figure 6:
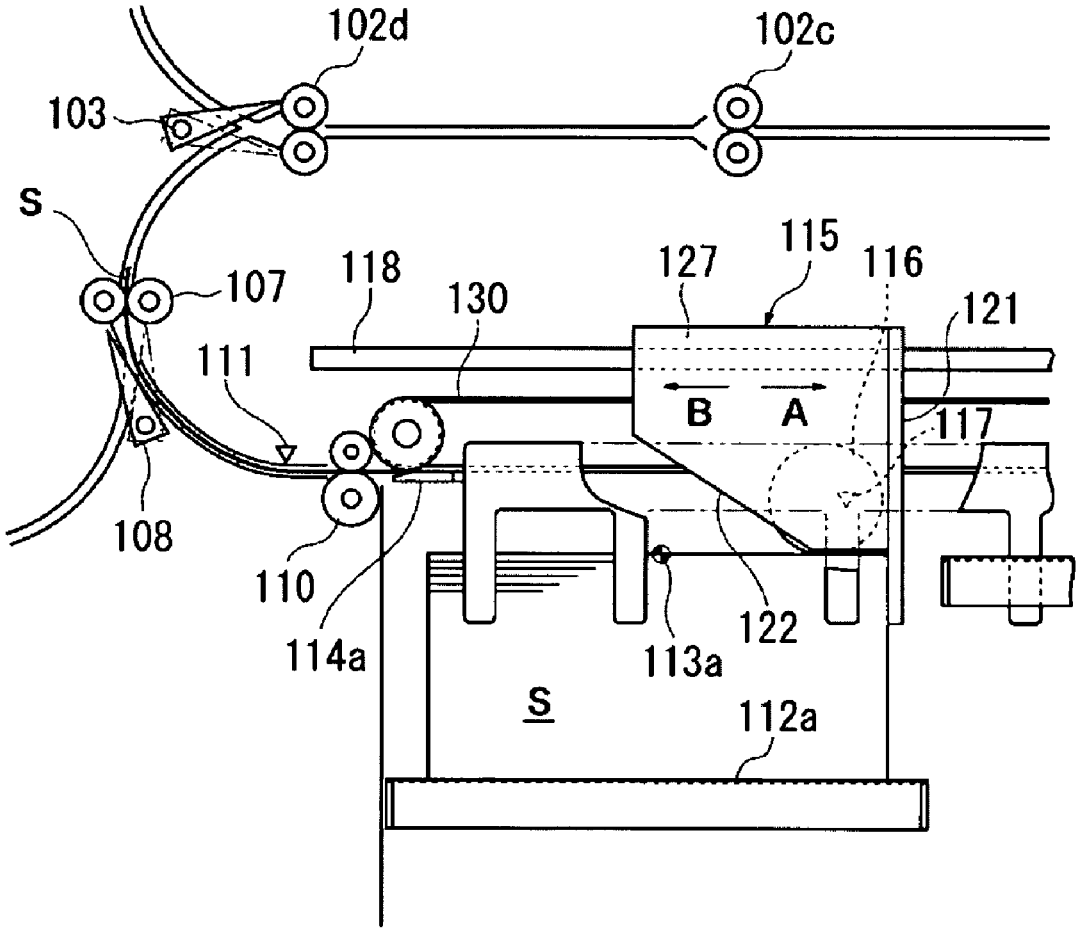
FIG. 6 illustrates a cross-sectional view of an example peripheral configuration of a first stacker tray included in the stacker apparatus illustrated in FIG. 4.
Figure 7:
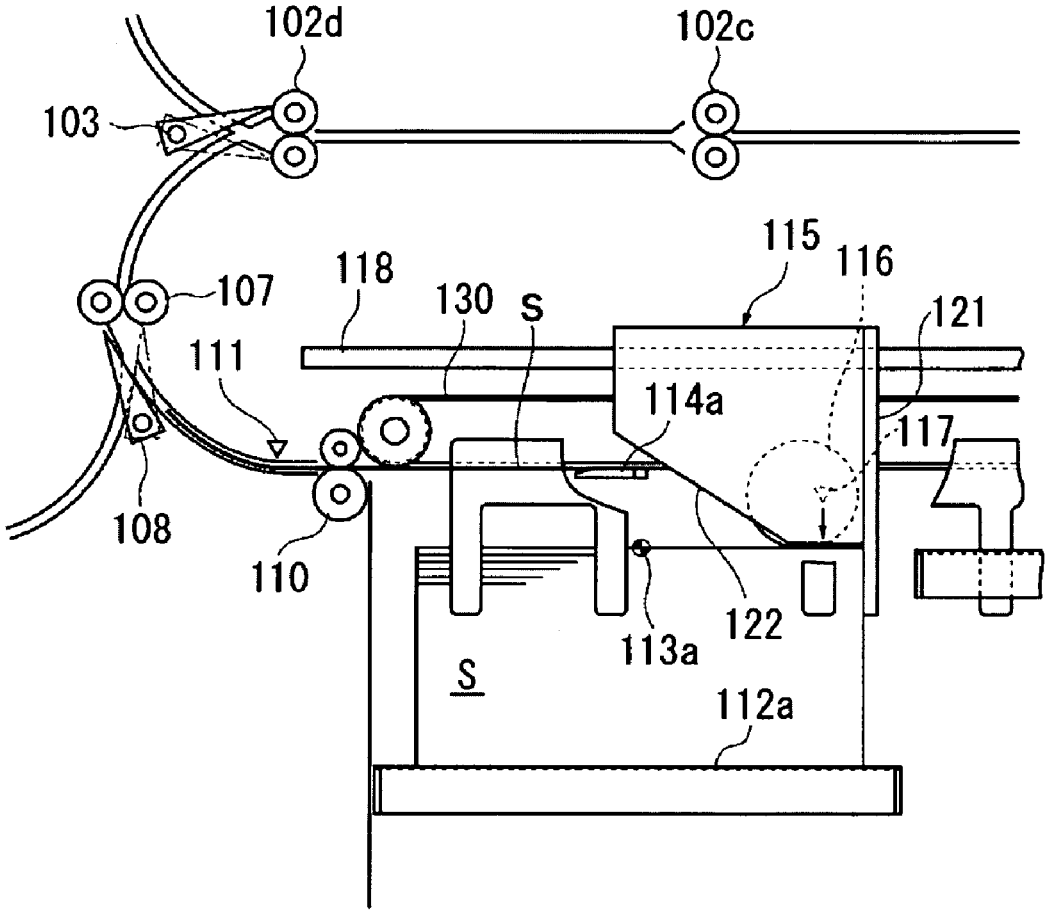
FIG. 7 illustrates a cross-sectional view of an example peripheral configuration of the first stacker tray included in the stacker apparatus illustrated in FIG. 4.

Referring to FIG. 6, the sheet S is discharged from the apparatus main body 900A (illustrated in FIG. 1) of the image forming apparatus 900 and conveyed to the discharge roller pair 110. A timing sensor 111 which is positioned upstream from the discharge roller pair 110 detects the timing at which the leading edge of the sheet passes. The gripper 114*a* which is standing by grips the leading edge of the sheet S at the detected timing. In sync with the gripping of the gripper 114*a*, the driving belt 130 starts to rotate, and the gripper 114*a* moves towards the drawing unit 115 while gripping the sheet S as illustrated in FIG. 7. FIG. 7 illustrates a second cross-sectional view of a peripheral configuration of the stacker tray 112*a* in the stacker apparatus 100 illustrated in FIG. 4.

Figure 8:
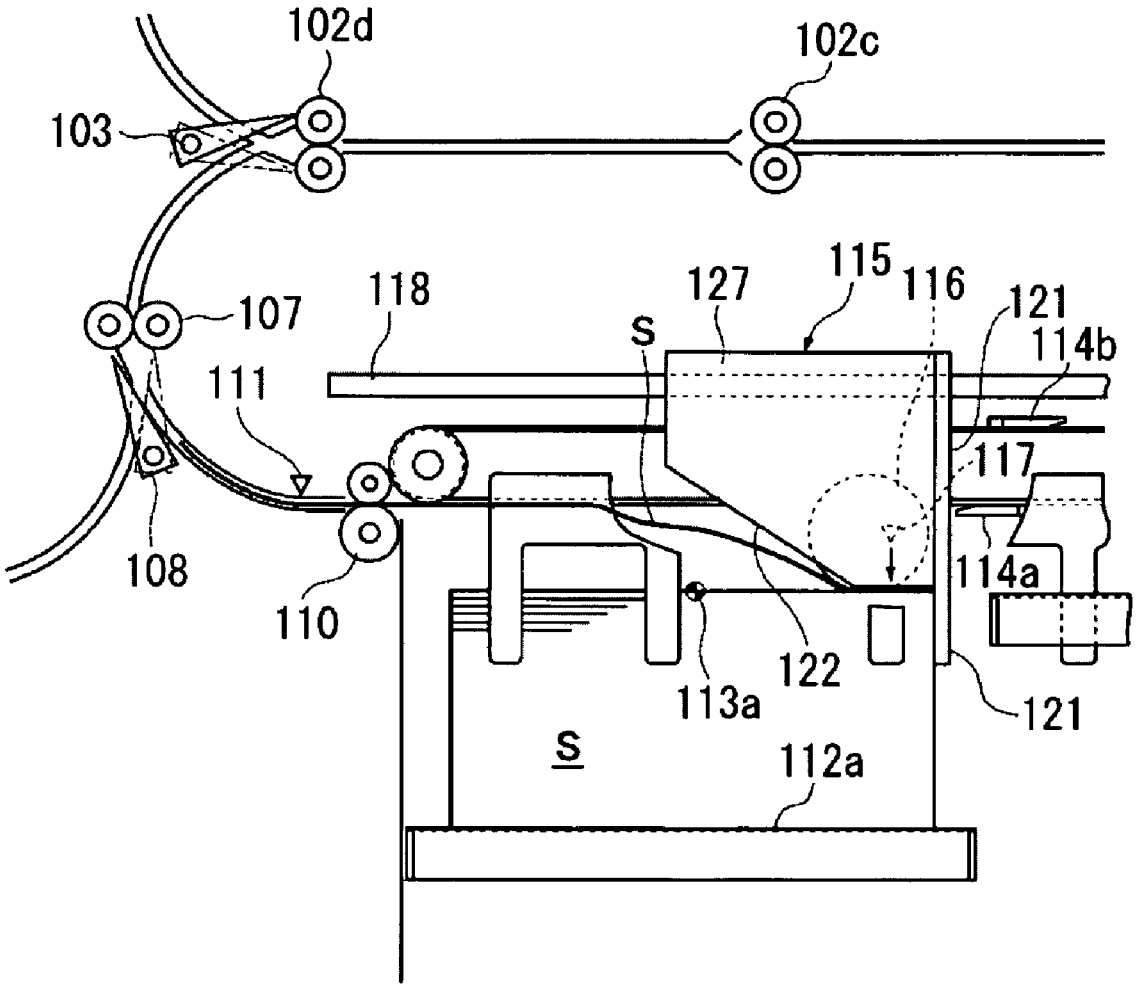
FIG. 8 illustrates a cross-sectional view of an example peripheral configuration of the first stacker tray included in the stacker apparatus illustrated in FIG. 4.
Figure 9:
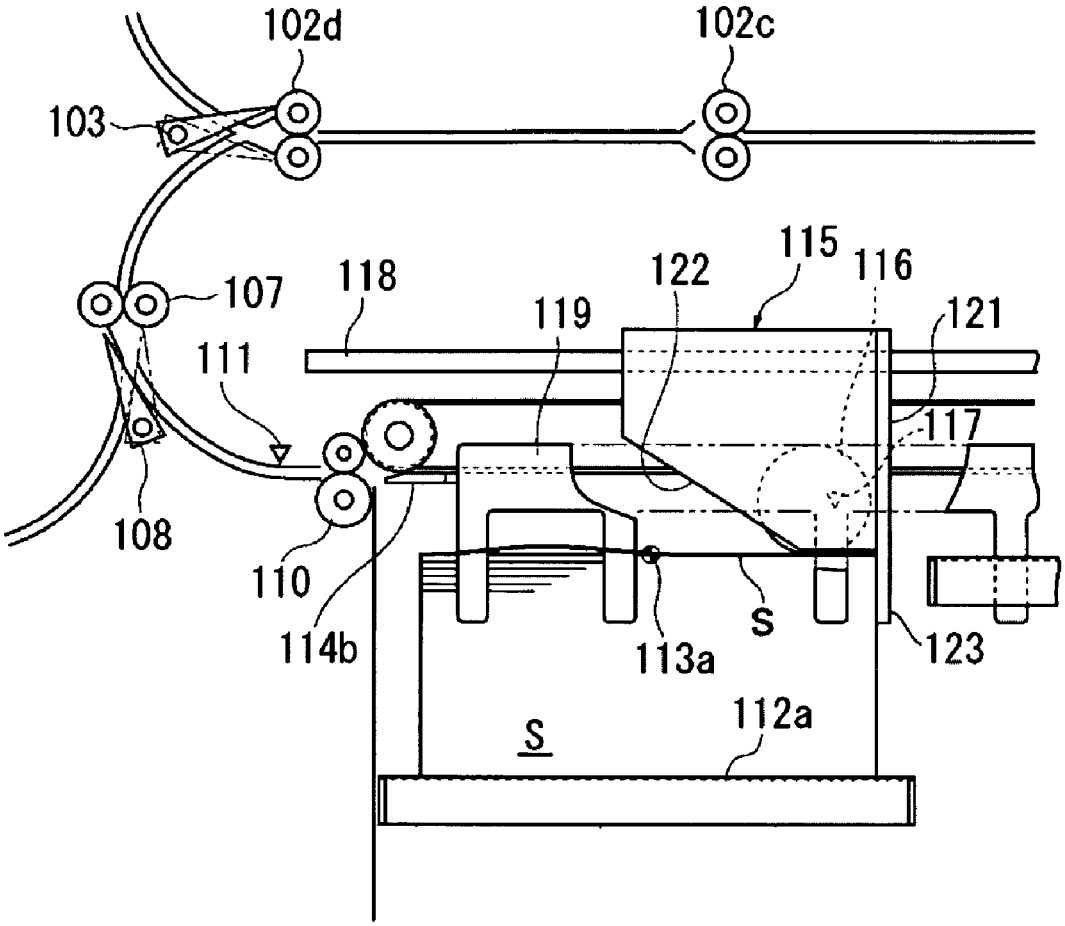
FIG. 9 illustrates a cross-sectional view of an example peripheral configuration of the first stacker tray included in the stacker apparatus illustrated in FIG. 4.

Referring to FIG. 8, when the gripper 114*a* passes through the taper unit 122 of the drawing unit 115, the gripper 114*a* releases the sheet S. The sheet S is guided to the taper unit 122 by momentum of the conveyance and is pushed to the side of the stacker tray 112*a*. The sheet S then enters between the knurled belt 116 and the stacker tray 112*a* (or the top sheet in a case where sheets are already stacked on the stacker tray 112*a*). The knurled belt 116 conveys the sheet S until the leading edge of the sheet S abuts on the stopper 121 as illustrated in FIG. 9. As a result, the leading edge of the sheet S is aligned, and the sheet S is stacked on the stacker tray 112*a* or on the top sheet.

An alignment plate 119 then aligns the side edge of the sheet by jogging the sheet in a direction perpendicular to the sheet conveying direction (i.e., a direction of the sheet width) (alignment in a width direction).

The sheet surface detection sensor 117 constantly monitors the upper surface of the sheet stacked on the stacker tray 112*a*. When the space between the knurled belt 116 of the drawing unit 115 and the sheet becomes narrower than a predetermined amount, the stacker tray elevating motor 152*a* lowers the stacker tray 112*a* by a predetermined amount. As a result, the space between the knurled belt 116 and the sheet is kept at the predetermined amount.

In the stacker apparatus 100, the driving belt 130 which is driven by the driving belt motor 155 (illustrated in FIG. 3) rotates, so that the two grippers 114*a* and 114*b* alternately grip sheets and sequentially stack the sheets on the stacker tray 112*a*.

Whether the sheets are fully-stacked on the stacker tray 112*a* can be determined as described below. The timing sensor 111 first detects a sheet S which is conveyed by the discharge roller pair 110. The stacker control unit 210 (i.e., detection unit, illustrated in FIG. 2) counts the number of times that the timing sensor 111 has detected a sheet, and detects a stacking amount of sheets, e.g., a number of stacked sheets. Whether the sheets are fully-stacked on the stacker tray 112*a* can be determined by comparing the detected number of stacked sheets with a previously set upper limit on stacking amount, e.g., an upper limit on a number of sheet stacking. For example, in the present exemplary embodiment, the maximum number of plain paper sheets that can be stacked (i.e., maximum stacking amount) on the stacker trays 112*a* and 112*b* is 5000 sheets. A user enters the above-described upper limit on stacking amount via the operation unit 209 of the image forming apparatus 900 or an operation screen (not illustrated) of the computer 200. A user can set the upper limit at less than a maximum stacking amount, e.g., maximum number of sheets to be stacked.

Further, whether the sheets are fully-stacked can be determined by measuring stacking time that is the elapsed time after stacking of the sheets on the stacker tray 112*a* started. The measured result is compared with a previously set upper limit on the stacking time.

Further, whether the sheets are fully-stacked can be determined by detecting the position of the stacker tray 112*a* and the position of the top sheet. That is, the full-stack can be determined by detecting and comparing the height of the sheet stack that is stacked on the stacker tray 112*a* with a previously set sheet stack height.

Therefore, the stacking amount, stacking time (elapsed time), and stacking height of the sheets are stacking parameter values that represent the degree of a stacking amount.

Figure 10:
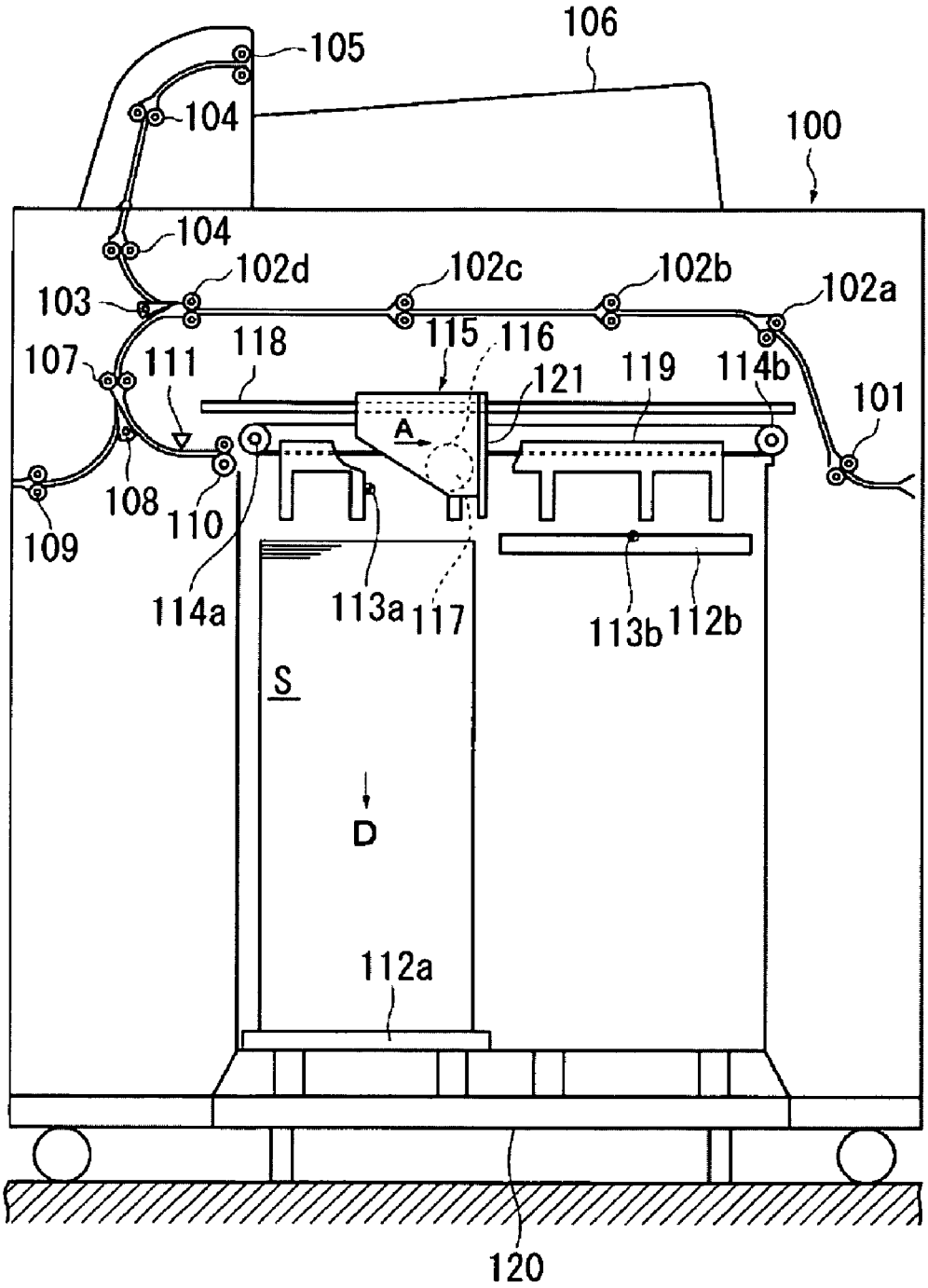
FIG. 10 illustrates a cross-sectional view of an example stacker apparatus in which a first stacker tray is lowered on top of a dolly.

In a case where the sheets on the stacker tray 112*a* are fully-stacked, the stacker control unit 210 (illustrated in FIG. 2) lowers the stacker tray 112*a* as illustrated in FIG. 10, and places the stacked sheets and the stacker tray 112*a* onto a dolly 120. The dolly transports the sheets together with the stacker tray 112*a*. The drawing unit 115 then moves in a direction indicated by an arrow A, and the stacker tray 112*b* waits for sheets to be stacked. FIG. 10 illustrates a cross-sectional view of the stacker apparatus 100 in which the stacker tray 112*a* is lowered onto the dolly 120.

Figure 11:
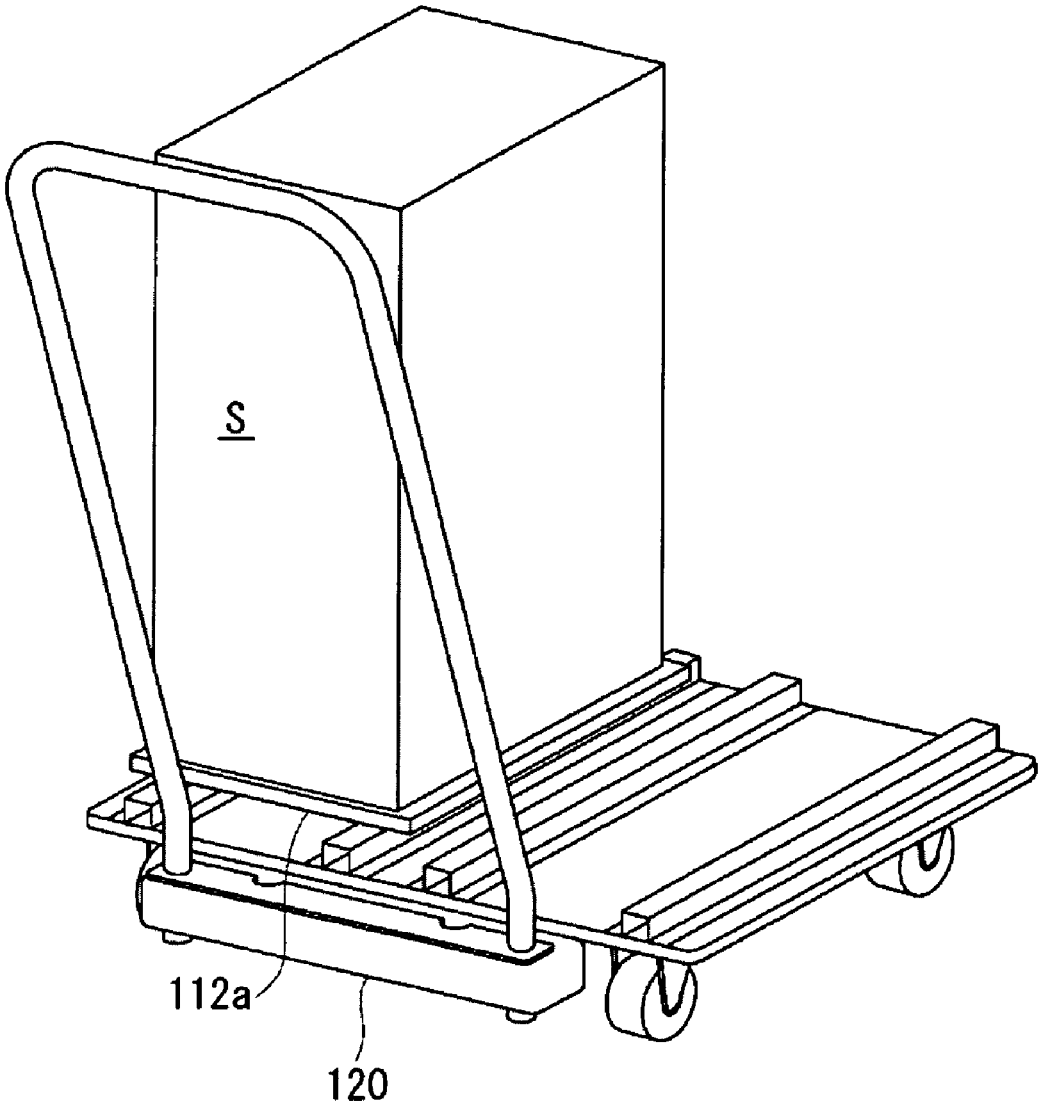
FIG. 11 illustrates how a first stacker tray on which sheet stacks are fully-stacked is taken out by a dolly.

Referring to FIG. 10, sheets that equal the set maximum number of sheets that can be stacked are stacked on the stacker tray 112*a*, and the stacker tray 112*a* is placed on the dolly 120. FIG. 11 illustrates how the stacker tray 112*a* on which sheets that equal the set maximum number of sheets are stacked is taken out using the dolly 120. As illustrated in FIG. 11, a user can take out the stacker tray 112*a* on which sheets are fully-stacked using the dolly 120, even if sheets are being stacked on the stacker tray 112*b* while images are formed. Therefore, a user can take out sheets that are stacked on a stacker tray while sheets on which images are formed are being stacked on another stacker tray in the image forming apparatus 900.

It is desirable that the standby position of the drawing unit 115 is at approximate center of each sheet to be stacked on the stacker trays 112*a* and 112*b* to keep stability. However, in order to stack a large amount of sheets, the standby position of the drawing unit 115 can be arranged at other positions as long as each sheet to be stacked is in a range that the sheet does not run off from the stacker trays 112*a* and 112*b*.

Figure 12:
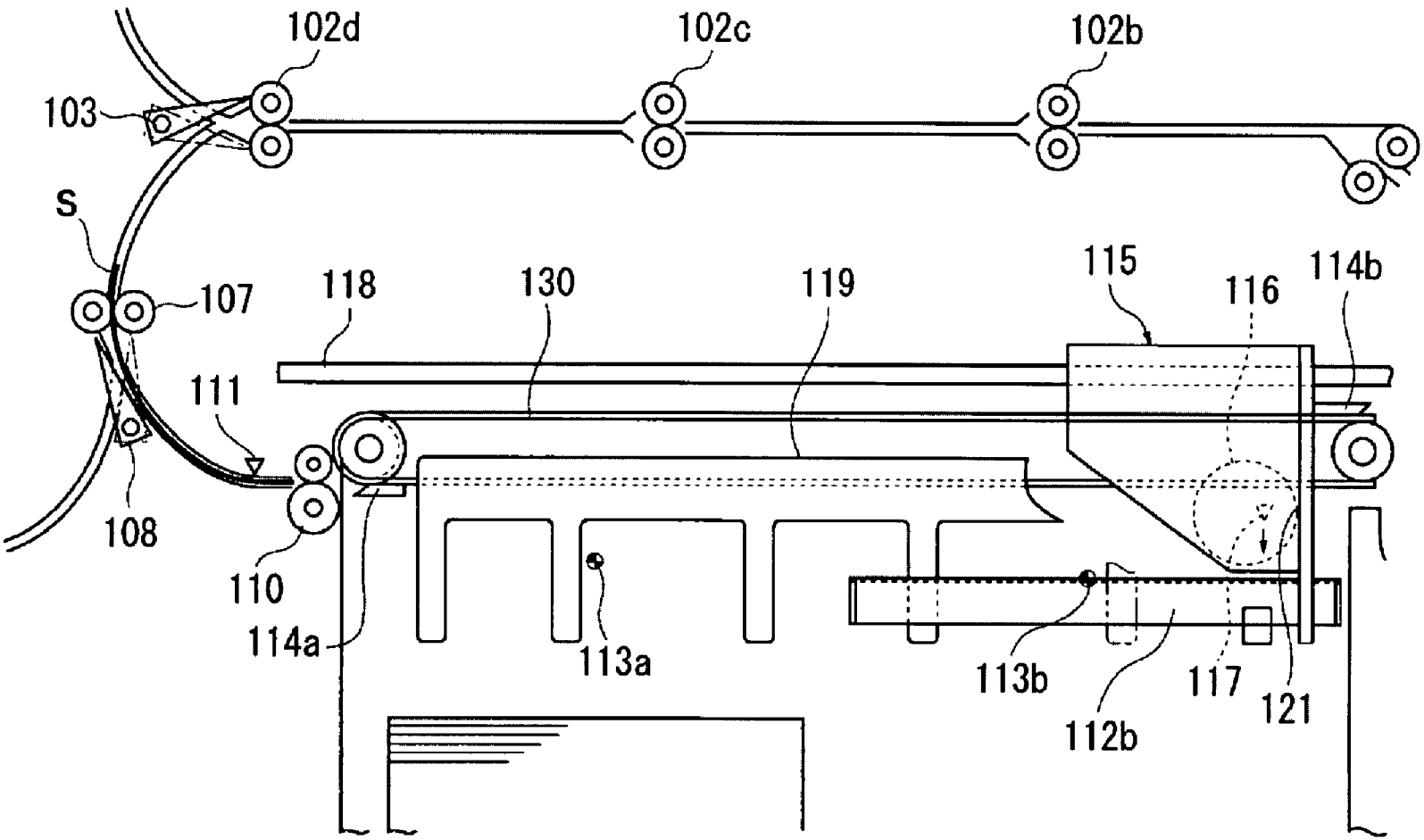
FIG. 12 illustrates a cross-sectional view of an example peripheral configuration of a second stacker tray included in the stacker apparatus illustrated in FIG. 4.
Figure 13:
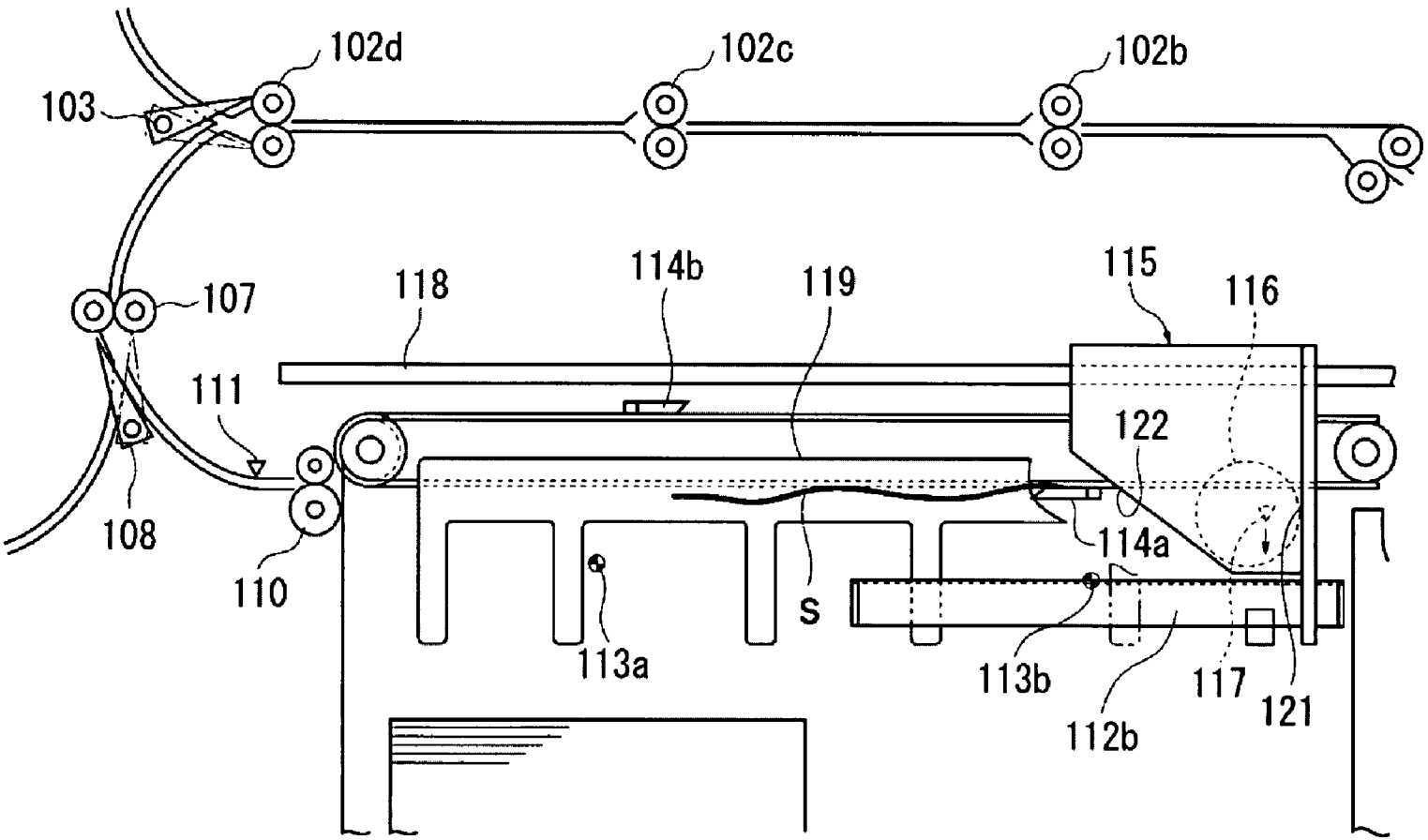
FIG. 13 illustrates a cross-sectional view of an example peripheral configuration of the second stacker tray included in the stacker apparatus illustrated in FIG. 4.
Figure 14:
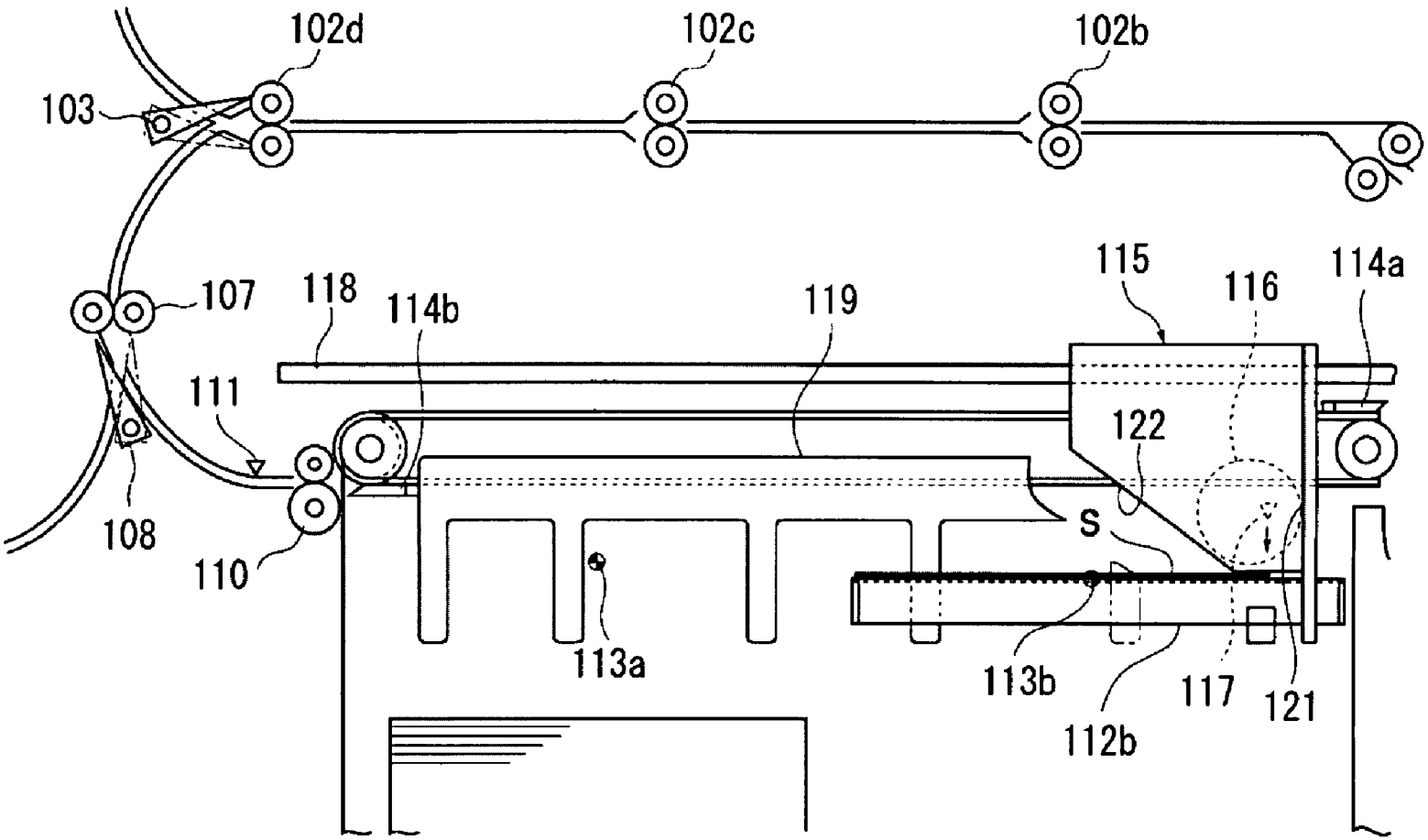
FIG. 14 illustrates a cross-sectional view of an example peripheral configuration of the second stacker tray included in the stacker apparatus illustrated in FIG. 4.

FIGS. 12, 13, and 14 illustrate cross-sectional views of a peripheral configuration of the stacker tray 112*b* in the stacker apparatus 100 illustrated in FIG. 4.

Referring to FIG. 12, a sheet S is discharged from the apparatus main body 900A of the image forming apparatus 900. After passing through the timing sensor 111, the sheet S is discharged by the discharge roller pair 110, and the leading edge of the sheet S is gripped by the gripper 114*a*.

Referring to FIG. 13, the gripper 114*a* then passes through the taper unit 122 of the drawing unit 115, and the leading edge of the sheet S is pushed toward the stacker tray 112*b* by the taper unit 122. The sheet S moves along the taper unit 122 and is guided to the knurled belt 116.

In FIG. 14, the knurled belt 116 causes the leading edge of the sheet S to abut on the stopper 121. The sheet S whose leading edge is aligned is stacked on the stacker tray 112*b*, and the side edge of the sheet S is further aligned by the aligning plate 119.

The sheet surface detection sensor 117 constantly monitors the top surface of the sheet stacked on the stacker tray 112*b*. When the space between the knurled belt 116 of the drawing unit 115 and the sheet becomes narrower than a predetermined distance, the stacker tray elevating motor 152*b* (illustrated in FIG. 3) is driven, and the stacker tray 112*b* is lowered by a predetermined amount. As a result, the space between the knurled belt 116 and the sheet is kept within a predetermined range.

In the stacker apparatus 100, the driving belt 130 rotates, and the two grippers 114*a* and 114*b* that are mounted on the driving belt 130 alternately grip the sheet, so that the grippers 114*a* and 114*b* sequentially stack each sheet on the stack tray 112*b*.

Determination of whether the sheets are fully-stacked on the stacker tray 112*b* is made similar to the determination performed for the stacker tray 112*a*. That is, the timing sensor 111 detects the sheet S which is conveyed by the discharge roller pair 110, and the stacker control unit 210 (illustrated in FIG. 2) counts the number of sheets discharged. Whether the sheets are fully-stacked on the stacker tray 112*b* can be determined by comparing the detected number of discharged sheets with a previously set upper limit on a number of sheets that can be stacked.

Further, whether the sheets are fully-stacked can be determined by measuring stacking time that is the elapsed time after stacking of the sheets on the stacker tray 112*b* started, and comparing the result with a previously set upper limit on the stacking time.

Further, whether the sheets are fully-stacked can be determined by detecting the lowered position of the stacker tray 112*b* and the position of the top sheet.

Figure 15:
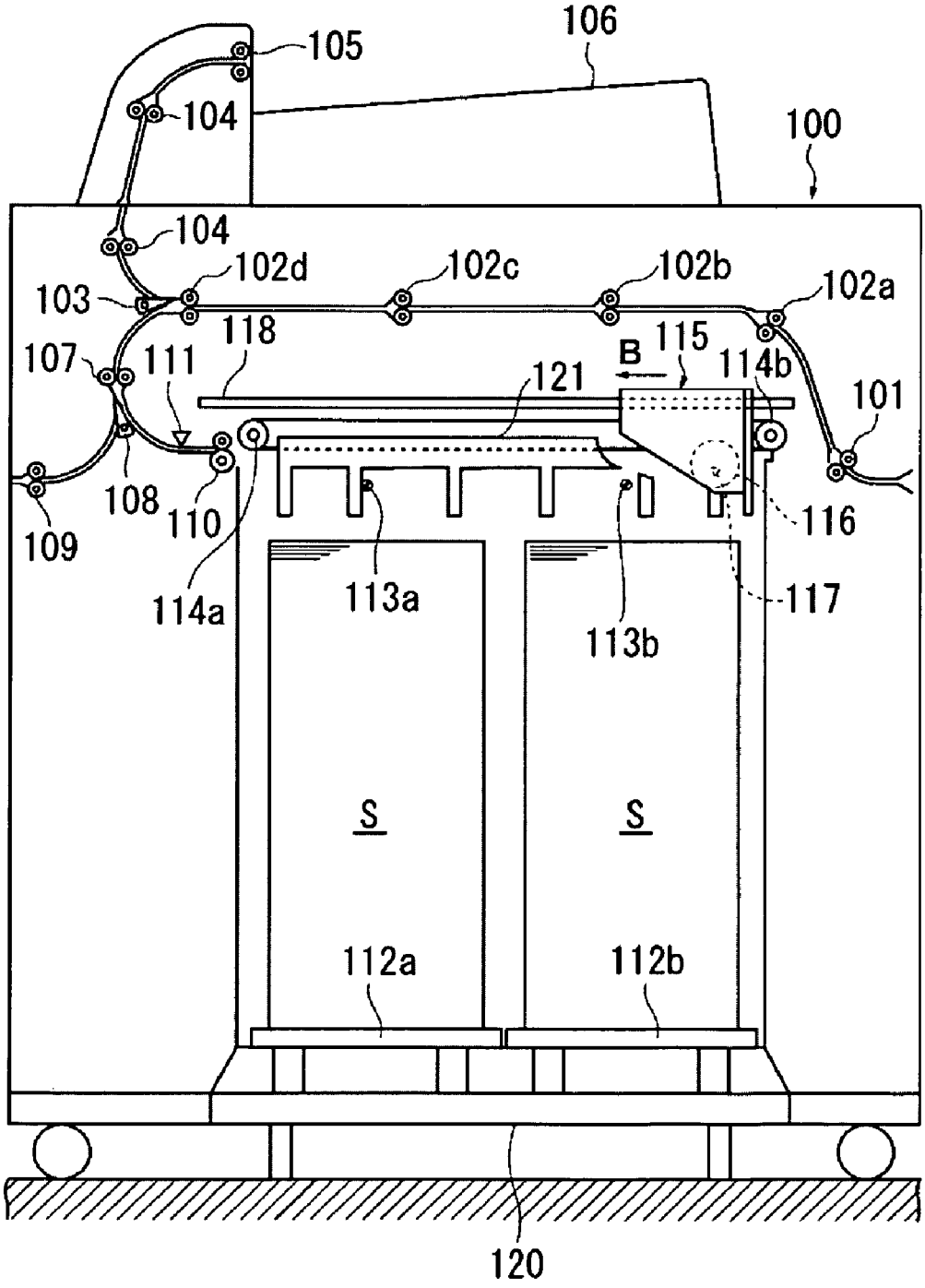
FIG. 15 illustrates a cross-sectional view of an example stacker apparatus in which a second stacker tray is lowered on top of a dolly.

In a case where the stacker tray 112*b* is fully-stacked with sheets, the stacker control unit 210 (illustrated in FIG. 2) lowers the stacker tray 112*b* as illustrated in FIG. 15, and places the stacker tray 112*b* onto the dolly 120. FIG. 15 is a cross-sectional view of the stacker apparatus 100 in which the stacker trays 112*a* and 112*b* are lowered down to a position where they rest on the dolly 120.

The drawing unit 115 then moves in the direction indicated by an arrow B illustrated in FIG. 15, and stands by above the stacker tray 112*a* on the left side of the stacker trays 112*a* and 112*b*.

Figure 16:
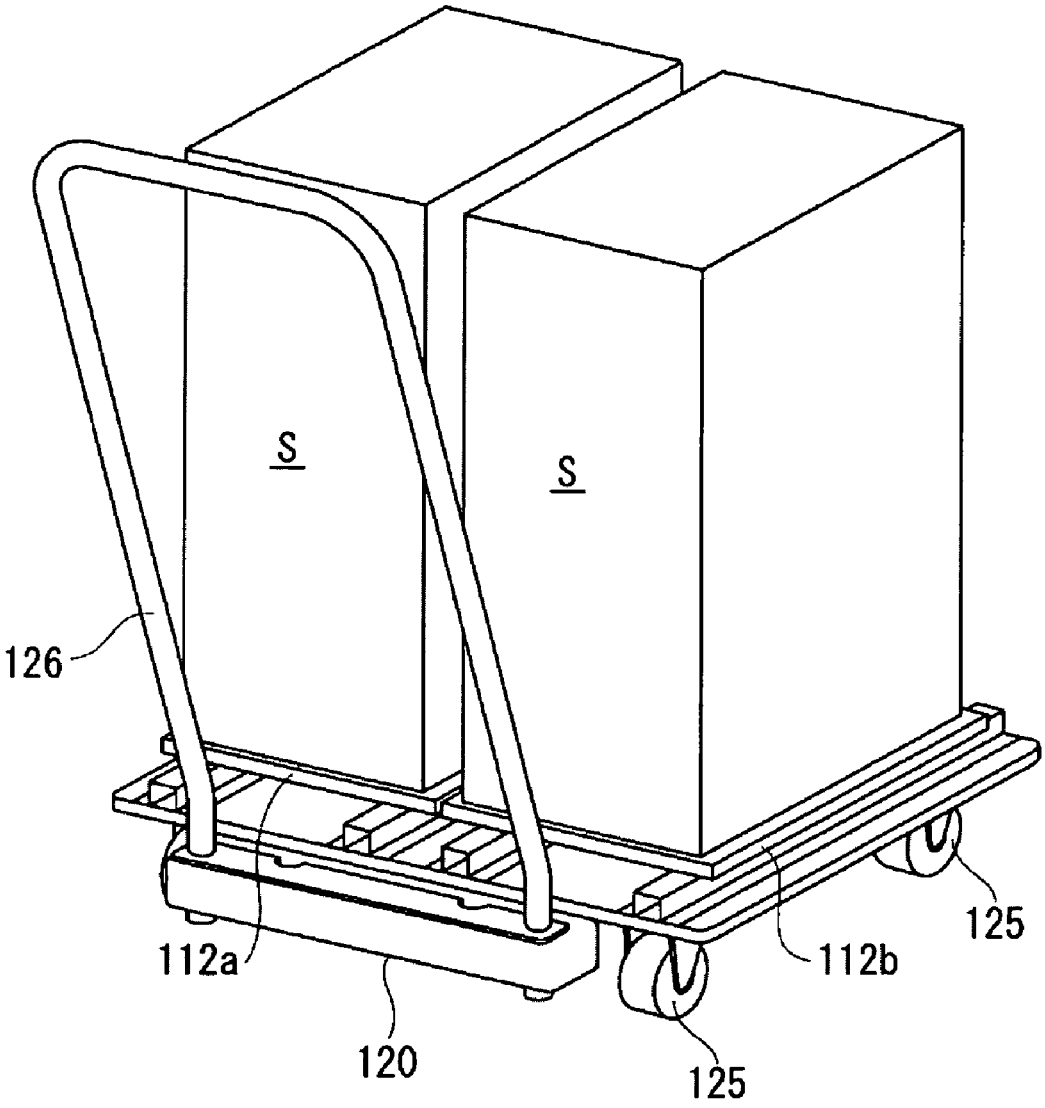
FIG. 16 illustrates a perspective view of two stacker trays and a dolly.

FIG. 16 illustrates a perspective view of the stacker trays 112*a*, 112*b* and the dolly 120.

The stacker trays 112*a* and 112*b* are supported by an elevatable supporting member (not illustrated). The stacker trays 112*a* and 112*b* are transferred to the dolly 120 by the supporting member that is lowered below the supporting surface of the dolly 120. As illustrated in FIG. 16, the stacker trays 112*a* and 112*b* are fixed on the dolly 120 by a fixing member such as a pin which is set on the upper surface of the dolly 120, and a large volume of sheet stacks can be stacked on the stacker trays 112*a* and 112*b*. The dolly 120 includes casters 125 and a handle 126, and a user can easily move a large volume of sheet stacks at once by holding the handle 126 of the dolly 120.

After the dolly 120 on which the stacker trays 112*a* and 112*b* are placed is taken out from the stacker apparatus 100, the image forming operation is stopped. The image forming operation can be restarted when the sheet stacks on the stacker trays 112*a* and 112*b* placed on the dolly 120 are removed, and the stacker trays 112*a* and 112*b*, and the dolly 120 are reloaded onto the stacker apparatus 100. The image forming operation can be promptly restarted by providing an auxiliary dolly and two stacker trays to the stacker apparatus 100.

Operation of previously setting or changing an upper limit on the number of sheets that can be stacked or the stacking time on each of the stacker trays 112*a* and 112*b* in the stacker apparatus 100 will be described below.

A user enters an upper limit on the number of sheets that can be stacked or the stacking time via the operation unit 209 of the image forming apparatus 900 (illustrated in FIG. 2), or an operation screen (not illustrated) of the computer 200.

FIGS. 17, 18, 19, 20, and 21 illustrate operation screens that are displayed on the operation unit 209 of the image forming apparatus 900 illustrated in FIG. 2. An operational procedure of changing settings of upper limit on the number of sheets that can be stacked or the stacking time using the operation screen will be described below.

Figure 17:
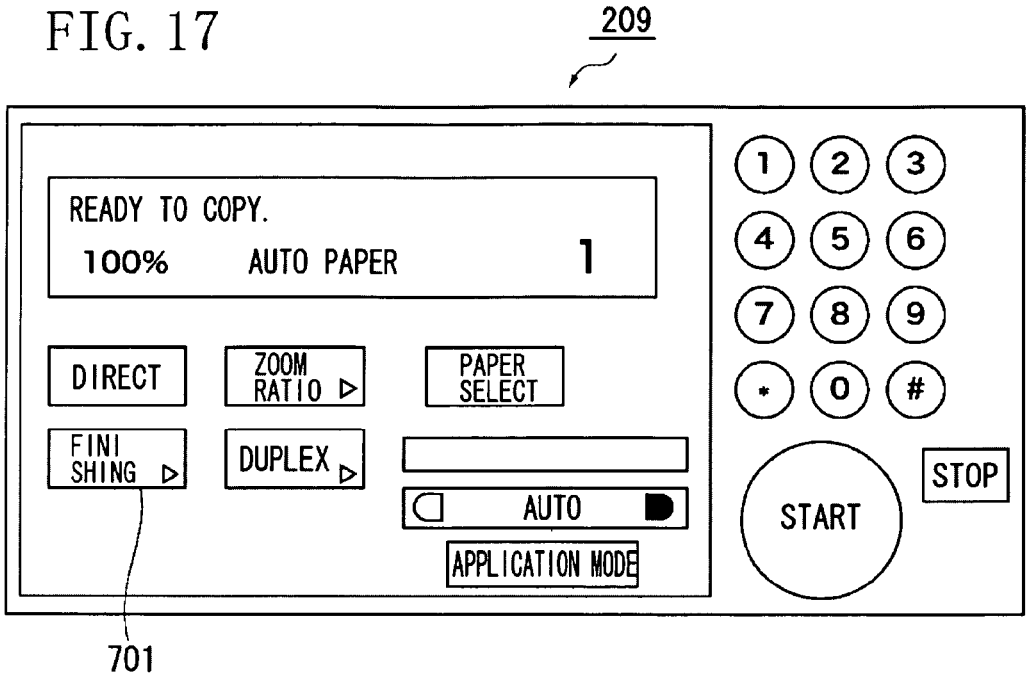
FIG. 17 illustrates an example operation screen that is displayed on an operation unit of an image forming apparatus illustrated in FIG. 2.

A key 701 in the operation screen illustrated in FIG. 17 can designate how the sheets are to be stacked (i.e., a stacking mode) after images are formed on the sheets. When a user presses the key 701, the screen jumps to the operation screen illustrated in FIG. 18.

Figure 18:
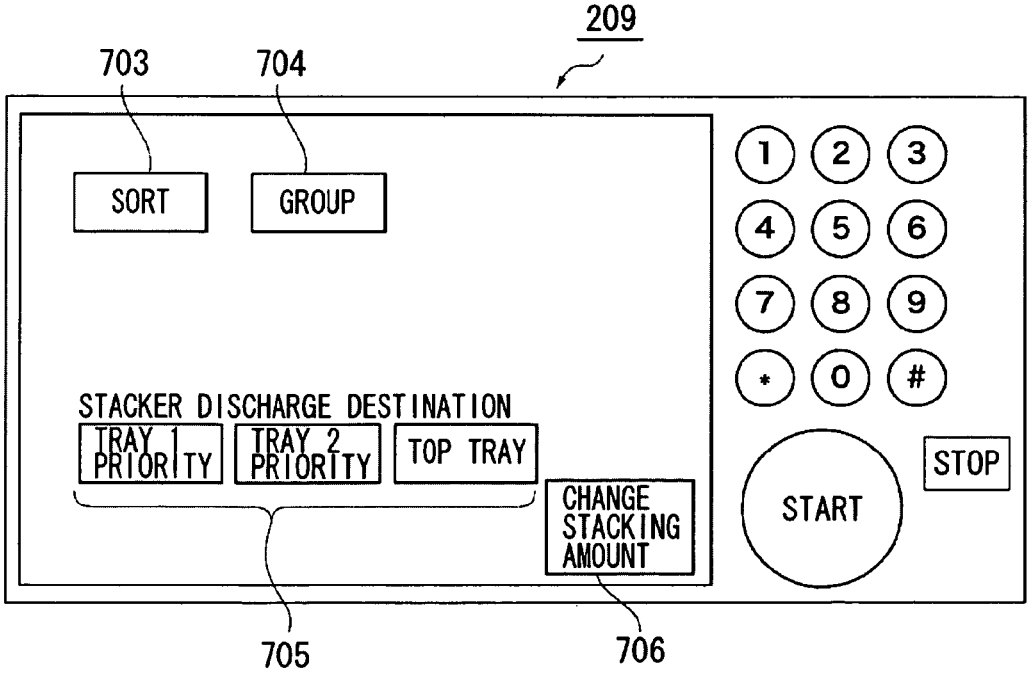
FIG. 18 illustrates an example operation screen that is displayed on the operation unit of the image forming apparatus illustrated in FIG. 2.

In the operation screen illustrated in FIG. 18, a key 703 is a key for setting a sort mode, and a key 704 is a key for setting a group mode. In a sort mode, sheets are sorted and stacked in units of copies, and in a group mode, sheets are grouped and stacked in units of pages. For example, if an original document consists of pages A, B, and C, and two copies of the document are to be printed, the sort mode performs printing in an order of A, B, C; A, B, C. On the other hand, the group mode performs printing in an order of A, A; B, B; C, C. Keys 705 are keys for designating a discharge destination of a sheet. A discharge destination "tray 1" corresponds to the stacker tray 112*a*, "tray 2" corresponds to the stacker tray 112*b*, and "top tray" corresponds to a top tray 106 (illustrated in FIG. 4).

A key 706 is a key for changing the setting of upper limit values of the number of sheets that can be stacked on the stacker trays 112*a* and 112*b*. The upper limit value of the sheet stack height can also be changed by the key 706. When a user presses the key 706, the screen jumps to the operation screen illustrated in FIG. 19.

Figure 19:
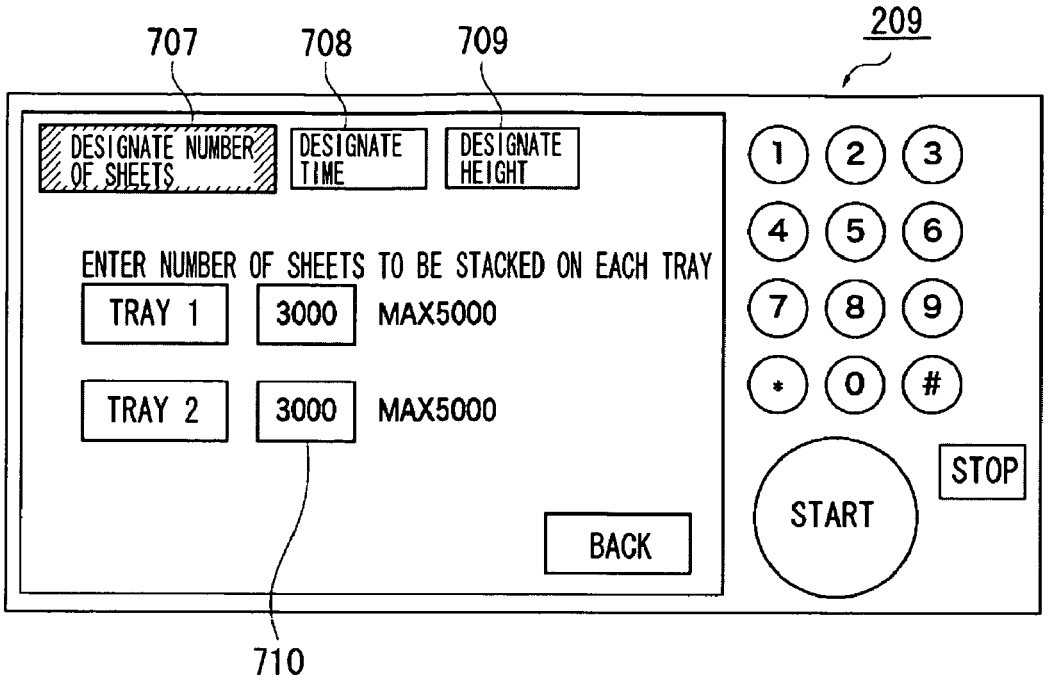
FIG. 19 illustrates an example operation screen that is displayed on the operation unit of the image forming apparatus illustrated in FIG. 2.

Referring to FIG. 19, a key 707 is a key for changing a setting of an upper limit on the number of sheets that can be stacked. A key 708 is a key for changing a setting of an upper limit on the stacking time of sheets to be stacked. A key 709 is a key for changing a setting of an upper limit on the stacking height of sheets to be stacked. The key 707 is selected in a default state.

When the key 707 is selected, a user can enter the upper limit on the number of sheets that can be stacked for each of the stacker trays (1) 112*a* and (2) 112*b* using numerical keypads. For example, if the user designates 3000 sheets as illustrated in FIG. 19, the designated value is displayed on a sheet number display portion 710. A user can set the upper limit value which is less than the maximum number of sheets that can be stacked on a stacker tray (e.g., 5000 sheets).

Setting an upper limit on a number of sheets that can be stacked as described above is effective in a case as described below.

Suppose that a user transports the sheets stacked on the stacker tray 112*a* by the dolly 120 to a bookbinding apparatus to perform a bookbinding process and the bookbinding apparatus can process 3000 sheets at once. Even if 5000 sheets are stacked on the stacker tray 112*a* and are transported to the bookbinding apparatus, only 3000 sheets can be set on the bookbinding apparatus, and the remaining 2000 sheets are left stacked on the dolly 120. In such a case, start of the bookbinding process is wastefully delayed by time which is required to stack the 3001st to 5000th sheets.

Therefore, the bookbinding apparatus can be efficiently operated if a user transports the sheets to the bookbinding apparatus when the number of stacked sheets on the stacker tray reaches the upper limit.

Figure 20:
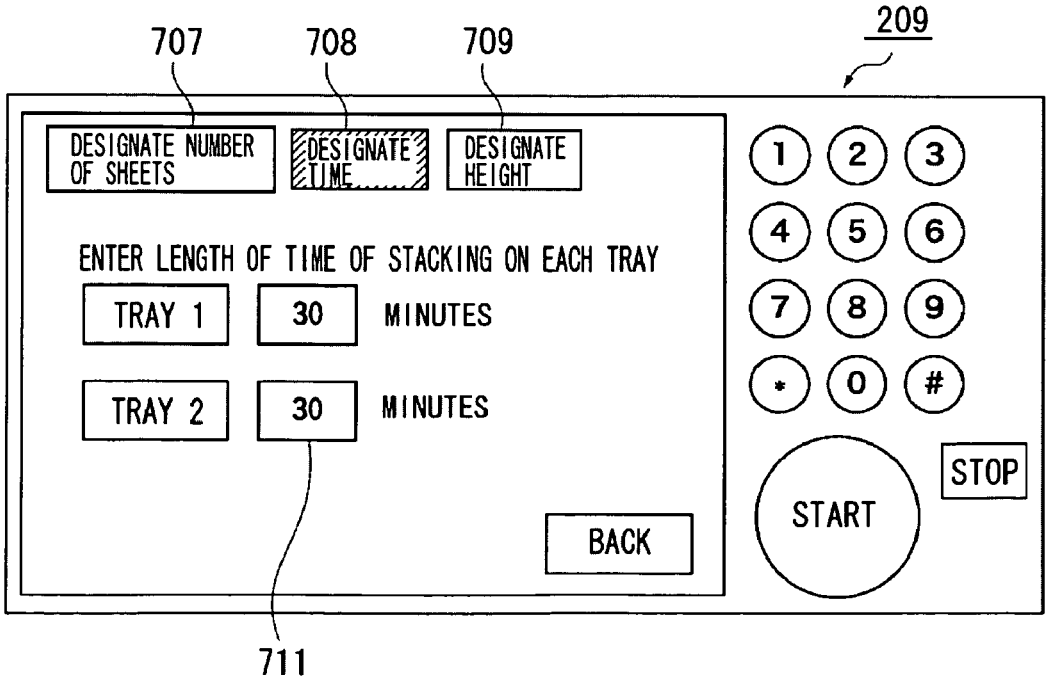
FIG. 20 illustrates an example operation screen that is displayed on the operation unit of the image forming apparatus illustrated in FIG. 2.

Further, if a user selects the key 708, the screen jumps to the operation screen illustrated in FIG. 20, and the user uses the numerical keypad to enter an upper limit value on the stacking time of each of the stacker trays (1) 112*a* and (2) 112*b*. For example, if a user designates 30 minutes as illustrated in FIG. 20, the designated time is displayed on a time display portion 711. When the set stacking time elapses from the start of stacking sheets on a stacker tray, the full-stacking of the stacker tray is detected, and stacking of sheets on the stacker tray is stopped.

Setting an upper limit on a stacking time of sheets as described above is effective in a case as described below.

Suppose that a user transports the stacked sheets on the stacker tray 112*a* by the dolly 120 to the bookbinding apparatus to perform a bookbinding process, and the time required for performing the bookbinding process is 30 minutes. When the set stacking time of 30 minutes elapses from the start of stacking the sheets on the stacker tray 112*b*, the bookbinding process also ends. Therefore, the bookbinding apparatus can be efficiently operated if the user transports the sheets that are stacked on the stacker tray 112*b* to the bookbinding apparatus.

Figure 21:
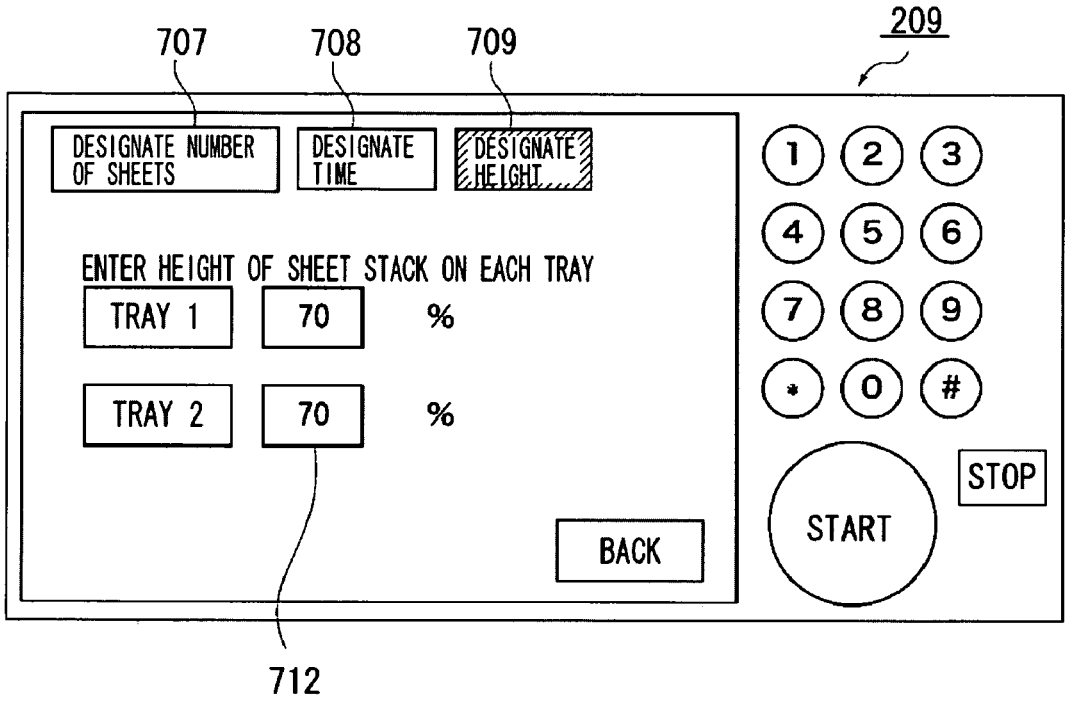
FIG. 21 illustrates an example operation screen that is displayed on the operation unit of the image forming apparatus illustrated in FIG. 2.

Further, if a user selects the key 709, the screen jumps to the operation screen illustrated in FIG. 21, and the user uses the numerical keypad to enter an upper limit value of the stacking height of each of the stacker trays (1) 112*a* and (2) 112*b*. For example, if the user designates 70% as illustrated in FIG. 21, the designated value is displayed on a height display portion 712. The upper limit value of the stacking height can be designated as a percentage of the maximum stacking height.

Setting an upper limit of the stacking height as described above is effective in a case where the amount of curling of sheets is large, so that the stacking amount of sheets needs to be suppressed to prevent the sheet stack from collapsing.

Stacker tray stacking control which is performed after a user changes the setting of each upper limit value by selecting one of the keys 707, 708, and 709 will be described below by referring to FIGS. 22 and 23.

Figure 22:
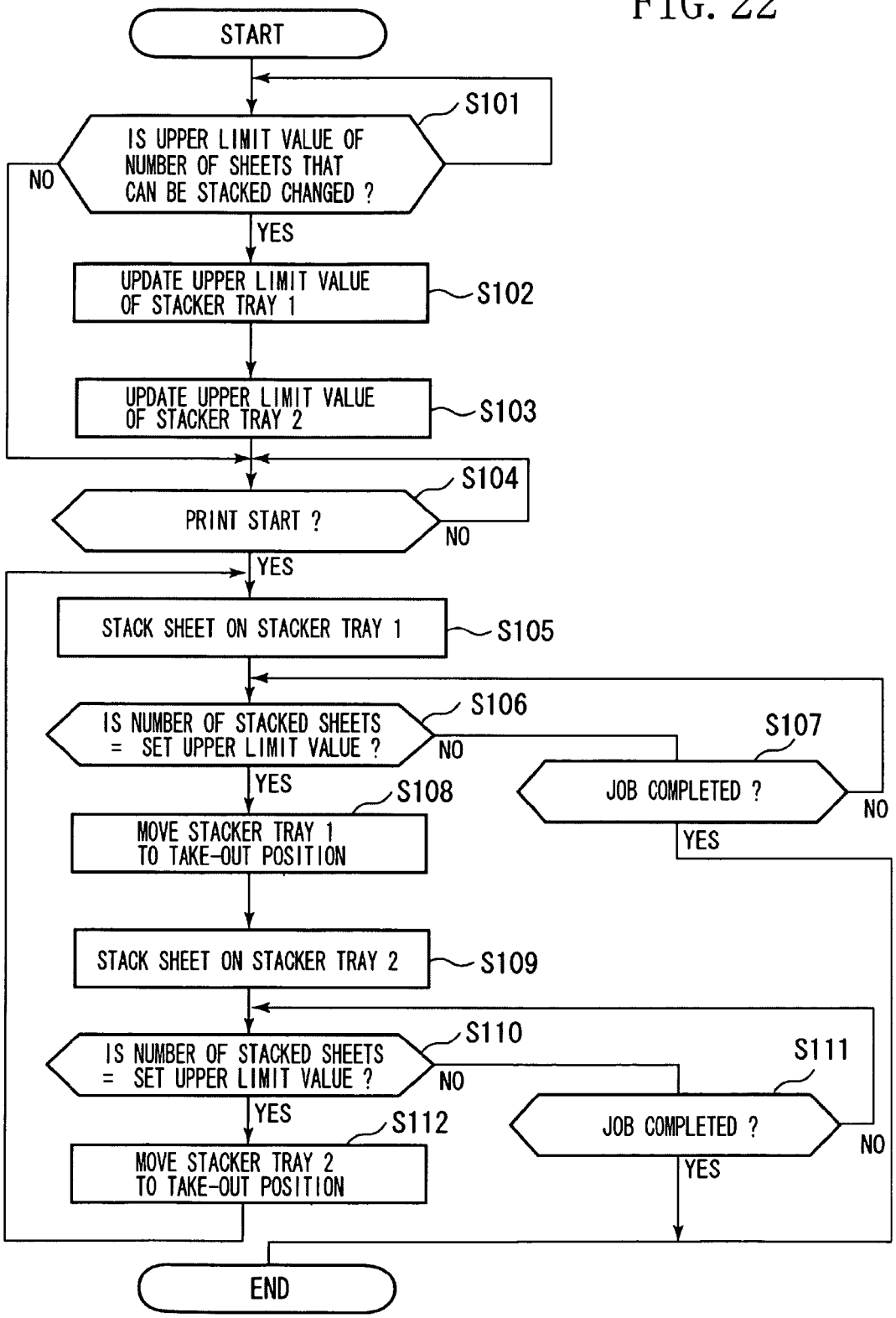
FIG. 22 is a flowchart illustrating a stacker tray stacking control process, based on a number of sheets that are stacked, performed by a stacker control unit illustrated in FIG. 3.

FIG. 22 is a flowchart illustrating a stacker tray stacking control process based on a number of sheets to be stacked. The process is performed by the CPU circuit unit 170 in the stacker control unit 210 illustrated in FIG. 3.

In step S101, the CPU circuit unit 170 determines whether upper limit of a number of sheets to be stacked on the stacker trays (1) 112*a* and (2) 112*b* have been changed, based on a signal received from the CPU circuit unit 206. In a case where the upper limit are changed (YES in step S101), the process proceeds to step S102. In step S102, the CPU circuit unit 170 updates the upper limit value of the number of sheets to be stacked on the stacker tray (1) 112*a* which is stored in the RAM to the newly set value. In step S103, the CPU circuit unit 170 updates the upper limit value of the number of sheets to be stacked on the stacker tray (2) 112*b* which is stored in the RAM to the newly set value. If the setting of the upper limit values is not changed (NO in step S101), the process proceeds to step S104.

In step S104, the CPU circuit unit 170 stands by until a print job (i.e., image forming job) is started. When the print job is instructed to start (YES in step S104), the process proceeds to step S105.

In step S105, the CPU circuit unit 170 stacks a sheet discharged from the image forming apparatus 900 onto a discharge destination designated by the CPU circuit unit 206 (i.e., a discharge destination designated by the keys 705 illustrated in FIG. 18). In the flowchart illustrated in FIG. 22, the stacker tray (1) 112*a* is designated as the discharge destination, so that the sheet is stacked on the stacker tray (1) 112*a*.

In step S106, the CPU circuit unit 170 determines whether the number of sheets that are stacked on the stacker tray (1) 112*a* has reached the upper limit value of the number of sheets to be stacked which was updated in step S102. If the number of stacked sheets has reached the upper limit value (YES in step S106), the process proceeds to step S108. If the number of stacked sheets has not reached the upper limit value (NO in step S106), the process proceeds to step S107.

In step S107, the CPU circuit unit 170 determines whether the print job is completed. If the CPU circuit unit 170 determines that the print job is not completed (NO in step S107), the process returns to step S106. On the other hand, if the print job is completed (YES in step S107), the process ends.

In step S108, the CPU circuit unit 170 moves the stacker tray (1) 112*a* to the lowest position, which is the take-out position, and places the stacker tray (1) 112*a* on the dolly 120.

In step S109, the CPU circuit unit 170 stacks sheets discharged from the image forming apparatus 900 on the stacker tray (2) 112*b*. In step S110, the CPU circuit unit 170 determines whether the number of stacked sheets on the stacker tray (2) 112*b* has reached the upper limit value of the number of sheets to be stacked which was updated in step S103. If the number of stacked sheets has reached the upper limit value (YES in step S110), the process proceeds to step S112. On the other hand, if the number of sheets has not reached the upper limit value (NO in step S110), the process proceeds to step S111.

In step S111, the CPU circuit unit 170 determines whether the print job is completed. If the CPU circuit unit 170 determines that the print job is not completed (NO in step S111), the process returns to step S110. On the other hand, if the print job is completed (YES in step S111), the present process ends.

In step S112, the CPU circuit unit 170 moves the stacker tray (2) 112*b* to the lowest position, which is the take-out position, and places the stacker tray (2) 112*b* on the dolly 120. Then, the process returns to step S105.

By the above-described process, a user can change a stacker tray to stack the sheets at a desired timing (or number of sheets). Therefore, the user can take out the stacker tray on which the sheets are already stacked from the stacker apparatus.

A user enters the upper limit value of the number of sheets to be stacked via the operation unit 209 before starting a print job. In addition, a user can enter the upper limit value while the print job is being executed. That is, the CPU circuit unit 206 can instruct updating the upper limit value during a print job. For example, if the upper limit value of a number of sheets to be stacked on the stacker tray (1) 112*a* is changed during a print job, the CPU circuit unit 170 makes the determination in step S106 based on the changed upper limit value.

Further, in steps S106 and S110 of the flowchart illustrated in FIG. 22, the stacker tray on which the sheets are to be stacked is changed to another stacker tray when the number of stacked sheets reaches the upper limit value of the number of sheets to be stacked. However, an operation mode can be set so that a discharge destination is changed to another stacker tray when the number of stacked sheets on the stacker tray reaches the upper limit value of the number of sheets to be stacked from which a predetermined number is subtracted. For example, a sheet stack can avoid being divided if a stacker tray of the discharge destination is changed based on a unit of the sheet stack (such as a sheet stack corresponding to a booklet) to be processed by a post-processed apparatus.

Figure 23:
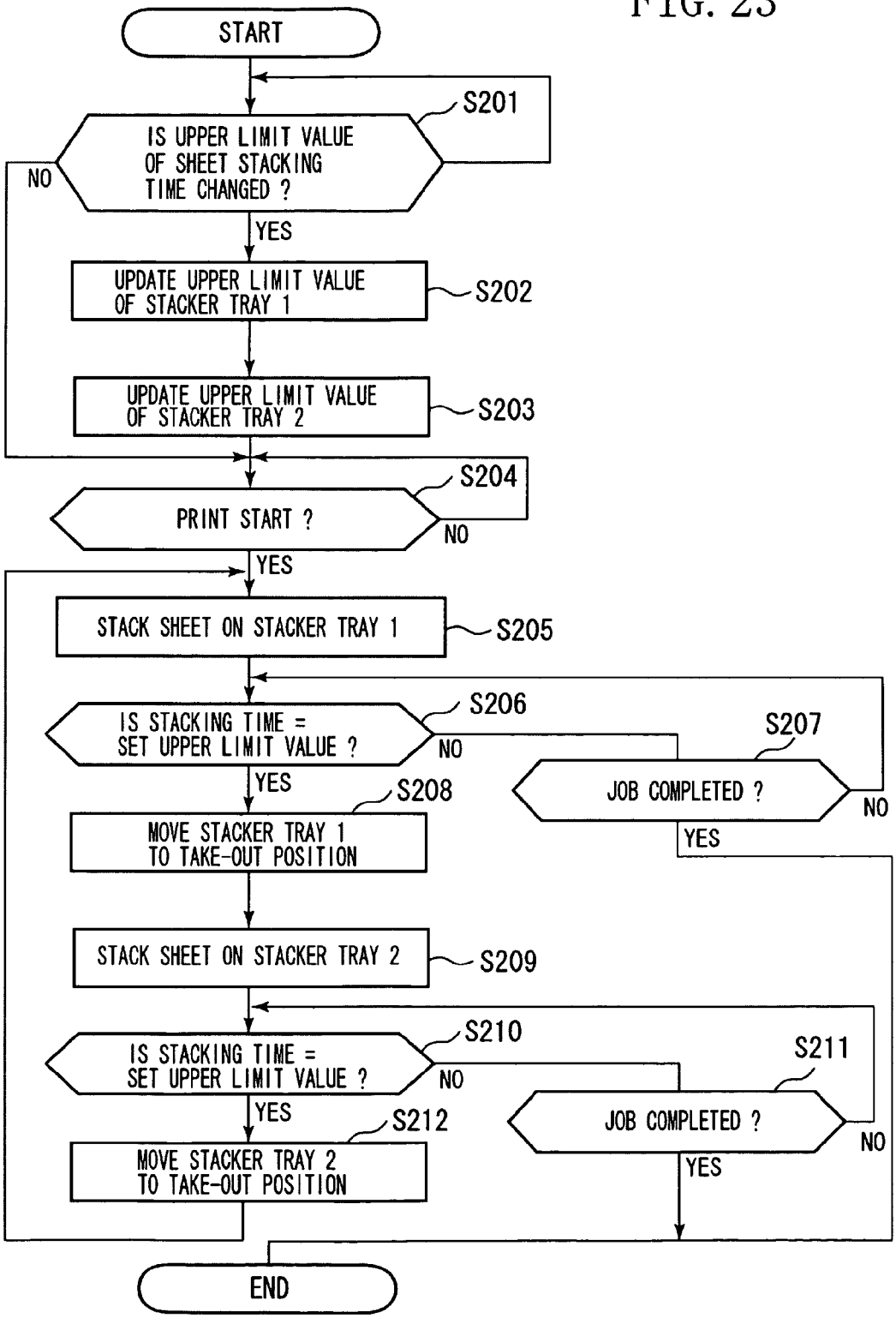
FIG. 23 is a flowchart illustrating a stacker tray stacking control process based on sheet stacking time, performed by the stacker control unit illustrated in FIG. 3.
Figure 24:
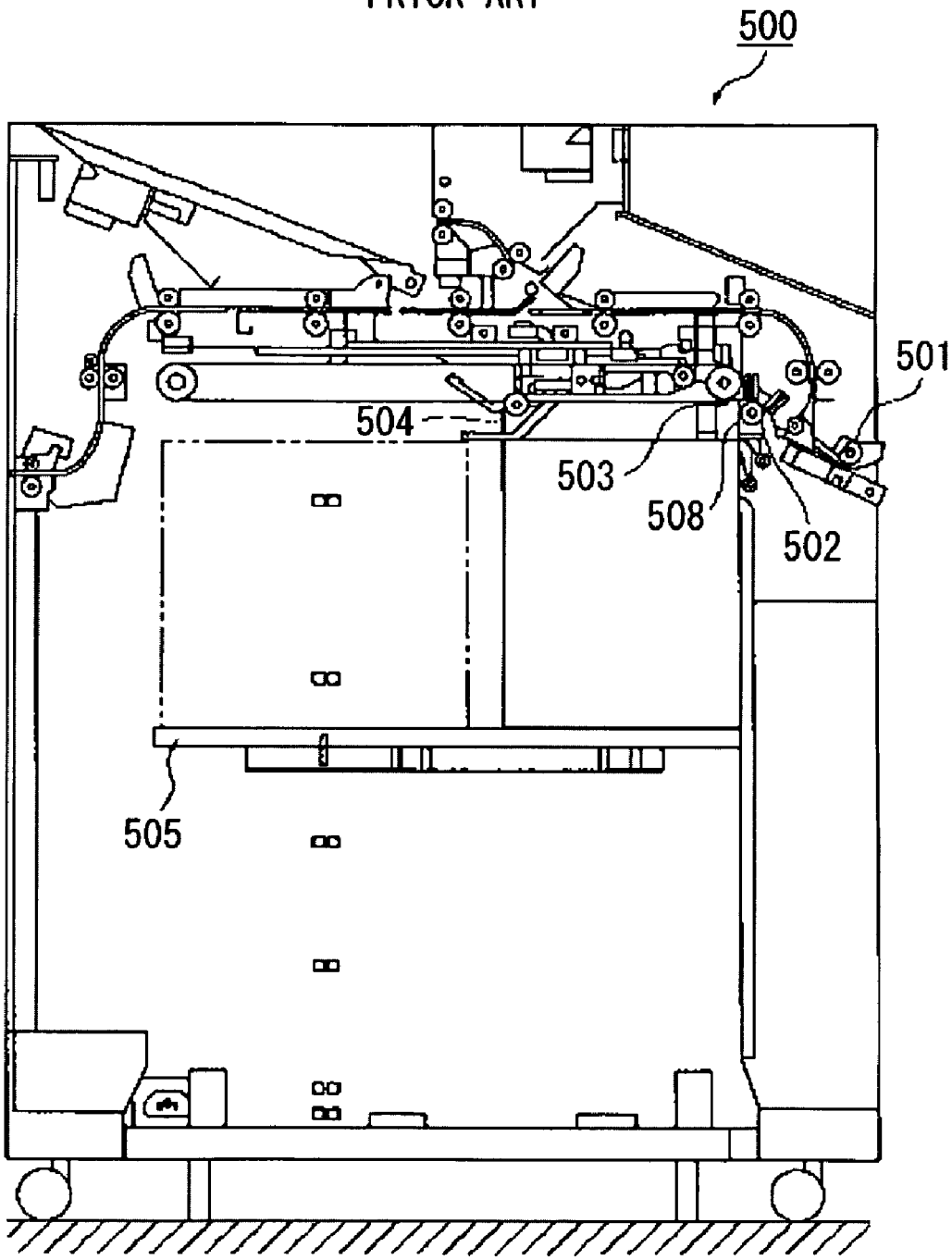
FIG. 24 PRIOR ART
FIG. 24 illustrates a cross-sectional view of a conventional stacker apparatus.

FIG. 23 is a flowchart illustrating a stacker tray stacking control process based on sheet stacking time. The process is performed by the CPU circuit unit 170 of the stacker control unit 210 illustrated in FIG. 3.

In step S201, the CPU circuit unit 170 determines whether upper limit values of a stacking time (i.e., time elapsing from the start of stacking) of stacking sheets on the stacker trays (1) 112*a* and (2) 112*b* have been changed, based on a signal received from the CPU circuit unit 206. In a case where the upper limit values are changed (YES in step S201), the process proceeds to step S202. In step S202, the CPU circuit unit 170 updates the upper limit value of the stacking time of the stacker tray (1) 112*a* stored in the RAM to the newly set value. In step S203, the CPU circuit unit 170 updates the upper limit value of the stacking time of the stacker tray (2) 112*b* stored in the RAM to the newly set value. If the setting of the upper limit value is not changed (NO in step S201), the process proceeds to step S204.

In step S204, the CPU circuit unit 170 stands by until a print job (i.e., image forming job) is started. When the print job is instructed to start (YES in step S204), the process proceeds to step S205.

In step S205, the CPU circuit unit 170 stacks a sheet discharged from the image forming apparatus 900 onto a discharge destination designated by the CPU circuit unit 206 (i.e., a discharge destination designated by the keys 705 illustrated in FIG. 18). In the flowchart illustrated in FIG. 23, the stacker tray (1) 112*a* is designated as the discharge destination, so that the sheet is stacked on the stacker tray (1) 112*a*.

In step S206, the CPU circuit unit 170 determines whether the stacking time of stacking sheets on the stacker tray (1) 112*a* has reached the upper limit value of the stacking time which was updated in step S202. If the stacking time has reached the upper limit value (YES in step S206), the process proceeds to step S208. If the stacking time has not reached the upper limit value (NO in step S206), the process proceeds to step S207.

In step S207, the CPU circuit unit 170 determines whether the print job is completed. If the CPU circuit unit 170 determines that the print job is not completed (NO in step S207), the process returns to step S206. On the other hand, if the print job is completed (YES in step S207), the process ends.

In step S208, the CPU circuit unit 170 moves the stacker tray (1) 112*a* to the lowest position, which is the take-out position, and places the stacker tray (1) 112*a* on the dolly 120.

In step S209, the CPU circuit unit 170 stacks sheets discharged from the image forming apparatus 900 on the stacker tray (2) 112*b*. In step S210, the CPU circuit unit 170 determines whether the stacking time for stacking the sheets on the stacker tray (2) 112*b* has reached the updated upper limit value (i.e., the set time) of the stacking time. If the stacking time has reached the upper limit value (YES in step S210), the process proceeds to step S212, and if not, the process proceeds to step S211.

In step S211, the CPU circuit unit 170 determines whether the print job is completed. If the print job is not completed (NO in step S211), the process returns to step S210. If the print job is completed (YES in step S211), the process ends.

In step S212, the CPU circuit unit 170 moves the stacker tray (2) 112*b* to the lowest position, which is the take-out position, and places the stacker tray (2) 112*b* on the dolly 120. The process then returns to step S205.

By the above-described process, a user can change the stacker tray on which the sheets are to be stacked at a desired timing (or time). Therefore, the user can take out the stacker tray on which the sheets are already stacked from the stacker apparatus.

A user enters the sheet stacking time via the operation unit 209 before starting a print job. In addition, a user can enter the sheet stacking time while the print job is being executed. That is, the CPU circuit unit 206 can instruct updating the sheet stacking time during a print job. For example, if the sheet stacking time of the stacker tray (1) 112*a* is changed during a print job, the CPU circuit unit 170 makes the determination in step S206 based on the changed sheet stacking time.

Further, in steps S206 and S210 of the flowchart illustrated in FIG. 23, the stacker tray on which the sheets are to be stacked is changed to another stacker tray when the sheet stacking time reaches the upper limit value of the sheet stacking time. However, an operation mode can be set so that a discharge destination is changed to another stacker tray when the sheet stacking time reaches the upper limit value of the sheet stacking time from which predetermined length of time is subtracted.

The stacker tray stacking control based on the stacking height is performed by the stacker control unit 210 illustrated in FIG. 3 according to the flowcharts illustrated in FIGS. 22 and 23. In such a case, "number of sheets to be stacked" and "sheet stacking time" is replaced by "sheet stacking height". Description on the process will be omitted.

Upper limit values of each of the above-described number of sheets to be stacked, sheet stacking time, and sheet stacking height can be set for each print job.

In the above-described exemplary embodiment, a user enters the upper limit value via the operation unit 209 of the image forming apparatus 900 or an operation screen (not illustrated) of the computer 200. However, the upper limit value can also be entered from an operation unit of the stacker apparatus 100.

Moreover, in the present exemplary embodiment, the stacker control unit 210 is included in the stacker apparatus 100. However, the stacker control unit 210 can be included in the image forming apparatus 900 instead.

In the present exemplary embodiment, the stacker apparatus 100 includes two stacker trays 112*a* and 112*b*. However, the stacker apparatus can include three or more stacker trays. Further, the image forming apparatus 900 can be connected to a plurality of stacker apparatuses having a stacker tray.

Other Exemplary Embodiments

The present invention can also be achieved by providing a storage medium which stores software (program code) for implementing functions of the above-described exemplary embodiments, to a system or an apparatus. The program code stored in the storage medium can be read and executed by a computer (central processing unit (CPU) or micro-processing unit (MPU)) of the system or the apparatus.

In this case, the software (program code) itself realizes the functions of the above-described exemplary embodiments. The software (program code) itself and the storage medium which stores the software (program code) constitute the present invention.

The storage medium can be, for example, a floppy disk, a hard disk, a magneto-optical disk, a compact disc-read-only memory (CD-ROM), a CD-recordable (CD-R), a CD-rewritable (CD-RW), a digital versatile disc (DVD)-ROM, a DVD-RAM, a DVD-RW, a DVD+RW, a magnetic tape, a nonvolatile memory card, or a ROM. Further, such software (program code) can be downloaded via a network.

Furthermore, the above-described exemplary embodiments can be not only realized by executing software (program code) read by a CPU. An operating system (OS) or the like working on a computer can also perform a part or the whole of processes according to instructions of the software (program code) and realize functions of the above-described exemplary embodiments.

Furthermore, software (program code) read from a storage medium can be stored in a memory equipped in a function expansion board inserted in a computer or a function expansion unit connected to a computer, and a CPU in the function expansion board or the function expansion unit can execute all or a part of the processing based on the instructions of the software (program code) to realize the functions of the above-described exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-123375 filed May 8, 2007, which is hereby incorporated by reference herein in its entirety.

What is claimed is:

1. A sheet stacking apparatus which stacks sheets that are discharged from an image forming apparatus, comprising:

first and second stacking trays configured to stack sheets;

a detection unit configured to detect a sheet stacking amount on the first stacking tray;

a setting unit configured to manually set a first upper limit on stacking amount for limiting the number of sheets stacked on the first stacking tray, wherein the first upper limit on stacking amount is equal to or less than a maximum sheet stacking amount on the first stacking tray; and a control unit configured to stop stacking of sheets on the first stacking tray and stack sheets on the second stacking tray in a case where the sheet stacking amount reaches the first upper limit on stacking amount, wherein the setting unit includes a selection unit configured to select a method of setting the first upper limit on stacking amount, and wherein the selection unit selects a first method of setting, as method of setting the first upper limit, an elapsed time from start of stacking sheets on the first stacking tray and a second method of setting parameters except the elapsed time.

2. The sheet stacking apparatus according to claim 1, wherein the setting unit sets the first upper limit on stacking amount for each image forming job.

3. The sheet stacking apparatus according to claim 1, wherein the sheet stacking apparatus stacks sheets, a size of which is equal to or smaller than a predetermined size, on each of the first stacking tray and the second stacking tray, and stacks sheets, a size of which is larger than the predetermined size, across the first stacking tray and the second stacking tray.

4. The sheet stacking apparatus according to claim 1, wherein, in a case where the setting unit changes the first upper limit on stacking amount while sheets discharged from the image forming apparatus are being stacked on the first stacking tray, the control unit determines whether the sheet stacking amount detected by the detection unit reaches the changed first upper limit on stacking amount.

* * * * *